US005202229A

United States Patent [19]

Kuse et al.

[11] Patent Number: 5,202,229

[45] Date of Patent: Apr. 13, 1993

[54] METHOD FOR FORMING A COLOR PHOTOGRAPHIC IMAGE

[75] Inventors: Satoru Kuse; Hiroaki Kobayashi, both of Tokyo, Japan

[73] Assignee: Konica Corporation, Tokyo, Japan

[21] Appl. No.: 734,790

[22] Filed: Jul. 23, 1991

[30] Foreign Application Priority Data

Jul. 26, 1990 [JP] Japan ..... 2-200209
Jul. 26, 1990 [JP] Japan ..... 2-200210

[51] Int. Cl.[5] ..... G03C 5/30; G03C 5/305; G03C 5/31

[52] U.S. Cl. ..... 430/399; 430/442; 430/963; 430/387

[58] Field of Search ..... 430/399, 387, 442, 963

[56] References Cited

U.S. PATENT DOCUMENTS 4,030,924 6/1977 Hofman ..... 430/963
5,004,675 4/1991 Yoneyama et al. ..... 430/963

FOREIGN PATENT DOCUMENTS

A-0366954 5/1990 European Pat. Off. .
63-231342 9/1988 Japan .

OTHER PUBLICATIONS

Patent Abstracts of Japan, vol. 12, No. 259 (P-733) (3106), Jul. 21, 1988.

*Primary Examiner*—Charles L. Bowers, Jr.
*Assistant Examiner*—Mark F. Huff
*Attorney, Agent, or Firm*—Finnegan, Henderson, Farabow, Garrett & Dunner

[57] ABSTRACT

A method for forming a color photographic image is disclosed. The method comprises steps of image wise exposing to light a silver halide color photographic light-sensitive material which has a silver halide emulsion layer containing silver halide grains having a silver chloride content of not less than 50 mol %, and the amount of silver coated on said light-sensitive material is not less than 2 g/m$^2$ in total, and developing said exposed light-sensitive material with a color developer containing a color developing agent represented by the following Formula I;

(I)

wherein $R_1$, $R_2$ and $R_3$ are independently a methyl group, an ethyl group, a propyl group, a hydroxyethyl group, sulfon-alkyl group or a $\beta$-methanesulfonamidoethyl group, provided that at least one of groups represented by $R_1$, $R_2$ and $R_3$ is a $\beta$-methanesulfonamidoethyl group; X is surfuric acid, hydrochloric acid, p-toluene-sulfonic acid or phosphoric acid.

20 Claims, No Drawings

METHOD FOR FORMING A COLOR PHOTOGRAPHIC IMAGE

FIELD OF THE INVENTION

This invention relates to a method for forming a color photographic image using a silver halide color photographic material.

BACKGROUND OF THE INVENTION

Generally, in the dye image formation method by silver halide color photographic light-sensitive material processing, imagewise exposure is followed by reaction of an oxidized p-phenylenediamine color developing agent and a dye forming coupler to form a dye image. In this method, color reproduction is normally based on subtractive color process, in which cyan, magenta and yellow dye images, corresponding to red, green and blue light exposure, are formed in respective light-sensitive layers. In recent years, it has been the common practice to use development at high temperature and simplify the processing process to shorten the processing time in the formation of such dye images. Particularly, to shorten the developing time, it is very important to increase the rate of color development. The rate of color development is affected by two factors: one is the silver halide color photographic light-sensitive material and the other is the color developer. In the former case, the grain composition of the silver halide emulsion used significantly affects the rate of development; in the latter case, the conditions and composition of the color developer significantly affect the rate of development.

Since it is more rapidly developable than a color photographic light-sensitive material comprising a silver halide emulsion containing silver bromide or silver iodide, such as a silver chlorobromide, silver chloroiodobromide or silver iodobromide emulsion, and is free of accumulation of bromide ions and iodide ions, which hampers development, in the color developer, a silver halide color photographic light-sensitive material wherein the light-sensitive silver halide emulsion substantially comprises silver chloride (hereinafter referred to as a silver chloride color photographic light-sensitive material) is very useful as a light-sensitive material for rapid processing.

Recently, there have been increasing demands for rapid processing of color photographic light-sensitive materials. To meet this requirement, color photographic light-sensitive materials have been proposed which incorporate a silver halide emulsion based mainly on silver chloride for high speed films for picture taking. The present inventors made investigations using a color photographic light-sensitive material based mainly on silver chloride, which is suitable to such rapid processing, and found that it has the following drawbacks.

First, when a color developer containing 3-methyl-4-amino-N-ethyl-N-$\beta$-hydroxyethylaniline sulfate (CD-4), a conventional color developing agent, is used to process the light-sensitive material, the fogging density increases because of the excess developing activity of CD-4.

Second, when a silver halide color photographic light-sensitive material for picture taking based mainly on silver chloride wherein the total amount of silver coated is as high as over 2 g/m$^2$ is continuously processed, silver sludge occurs in the color developer tank. In other words, in comparison with silver iodobromide emulsions used in conventional light-sensitive materials with a high amount of silver coated, emulsions based mainly on silver chloride are more liable to silver sludge, which poses a major problem in practical application.

This problem has recently become increasingly serious since it is a recent trend to reduce the amount of replenisher from the viewpoint of cost reduction and suppression of environmental pollution.

SUMMARY OF THE INVENTION

It is an object of the invention to provide a silver halide color photographic light-sensitive material processing method wherein the rapid developability is excellent, fogging of light-sensitive material is suppressed, formation of silver sludge in the color developer tank is prevented and the processing stability is excellent.

The method of the invention comprises steps of imagewise exposing to light a silver halide color photographic light-sensitive material which has a silver halide emulsion layer containing silver halide grains having a silver chloride content of not less than 50 mol%, and the amount of silver coated on said light-sensitive material is not less than 2 g/m$^2$ in total, and developing said exposed light-sensitive material with a color developer containing a color developing agent represented by the following Formula I.

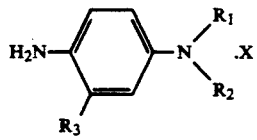

Formula I wherein $R_1$, $R_2$ and $R_3$, whether identical or not, independently represent a methyl group, ethyl group, propyl group, hydroxyethyl group, sulfonalkyl group or $\beta$-methanesulfonamidoethyl group, wherein at least one of $R_1$, $R_2$ and $R_3$ is a $\beta$-methanesulfonamidoethyl group; X represents a sulfuric acid, hydrochloric acid, p-toluenesulfonic acid or phosphic acid.

It is a preferred mode of embodiment of the present invention is that 1) the amount of replenisher for the color developer is not more than 900 ml per m$^2$ of processed light-sensitive material, or 2) the color processing time is within 150 seconds.

DETAILED DESCRIPTION OF THE INVENTION

The color developer used for the invention incorporates the compound represented by the formula I as a color developing agent.

Examples of the compound of the present invention represented by the formula I are given below.

| | $R_1$ | $R_2$ | $R_3$ | X |
|---|---|---|---|---|
| 1-1 | $-C_2H_5$ | $-C_2H_4NHSO_2CH_3$ | $-CH_3$ | $3/2H_2SO_4.H_2O$ |
| 1-2 | $-CH_3$ | $-C_2H_4NHSO_2CH_3$ | $-CH_3$ | HCl |

-continued

| | $R_1$ | $R_2$ | $R_3$ | X |
|---|---|---|---|---|
| 1-3 | $-C_2H_4NHSO_2CH_3$ | $-C_2H_4NHSO_2CH_3$ | $-CH_3$ | $3/2H_2SO_4.H_2O$ |
| 1-4 | $-CH_3$ | $-CH_3$ | $-C_2H_4NHSO_2CH_3$ | 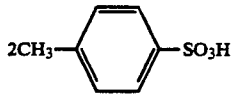 |
| 1-5 | $-C_2H_5$ | $-C_2H_5$ | $-C_2H_4NHSO_2CH_3$ | $3/2H_2SO_4.H_2O$ |
| 1-6 | $-C_2H_4OH$ | $-C_2H_4NHSO_2CH_3$ | $-CH_3$ | $H_2SO_4$ |
| 1-7 | $-C_3H_7$ | $-C_2H_4NHSO_2CH_3$ | $-CH_3$ | HCl |
| 1-8 | $-C_2H_4SO_3H$ | $-C_2H_4NHSO_2CH_3$ | $-CH_3$ | $\frac{1}{2}H_2SO_4$ |
| 1-9 | $-C_2H_5$ | $-C_2H_4NHSO_2CH_3$ | $-C_2H_5$ | HCl |

Of the compounds represented by the formula I, the compound 1-1 is preferably used.

The concentration of these compounds is preferably $1\times10^{-2}$ to $2\times10^{-1}$ mol per liter of color developer, but it is more preferable from the viewpoint of rapid processing to use them at a concentration of from $1.5\times10^{-2}$ to $2\times10^{-1}$ mol.

From the viewpoint of the desired effect of the present invention, the amount of replenisher for the color developer in the invention is preferably not more than 900 ml per $m^2$ of processed light-sensitive material, more preferably 20 to 700 ml per $m^2$ of processed light-sensitive material, and still more preferably 30 to 500 ml per $m^2$ of processed light-sensitive material.

The color processing time in the present invention is preferably within 150 seconds, but for the enhancement of the desired effect of the invention, it is more preferable that the color processing time is 10 to 120 seconds, still more preferably 20 to 100 seconds, and ideally 30 and 70 seconds.

When the compound represented by the following Formula A or B is contained in the color developer of the present invention, the effect of the invention is enhanced and tar formation is suppressed.

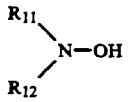

Formula A wherein $R_{11}$ and $R_{12}$ independently represent a alkyl group, aryl group,

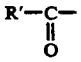

or hydrogen atom, provided that $R_{11}$ and $R_{12}$ do not represent a hydrogen atom at the same time. Each of the alkyl groups represented by $R_{11}$ and $R_{12}$, whether identical or not, is preferably an alkyl group having 1 to 3 carbon atoms. Examples of the substituent include a hydroxyl group, carboxyl group, sulfonic acid group, phosphonic acid group and alkoxy group.

R' represents an alkoxy group, alkyl group or aryl group. The alkyl groups and aryl groups for $R_{11}$, $R_{12}$ and R' include those having a substituent. $R_{11}$ and $R_{12}$ may bind together to form a ring, such as a piperidine, pyridine, triazine, morpholine or another heterocyclic ring.

Examples of the hydroxylamine compound represented by the above formula A are given in U.S. Pat. Nos. 3,287,125, 3,293,034 and 3,287,124 and other publications. Examples of particularly preferable compounds are given below.

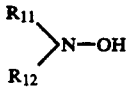

| Exemplified Compound Number | $R_{11}$ | $R_{12}$ |
|---|---|---|
| A-1 | $-C_2H_5$ | $-C_2H_5$ |
| A-2 | $-CH_3$ | $-CH_3$ |
| A-3 | $-C_3H_7(n)$ | $-C_3H_7(n)$ |
| A-4 | $-C_3H_7(i)$ | $-C_3H_7(i)$ |
| A-5 | $-CH_3$ | $-C_2H_5$ |
| A-6 | $-C_2H_5$ | $-C_3H_7(i)$ |
| A-7 | $-CH_3$ | $-C_3H_7(i)$ |
| A-8 | $-H$ | $-C_2H_5$ |
| A-9 | $-H$ | $-C_3H_7(n)$ |
| A-10 | $-H$ | $-CH_3$ |
| A-11 | $-H$ | $-C_3H_7(i)$ |
| A-12 | $-C_2H_5$ | $-C_2H_4OCH_3$ |
| A-13 | $-C_2H_4OH$ | $-C_2H_4OH$ |
| A-14 | $-C_2H_4SO_3H$ | $-C_2H_5$ |
| A-15 | $-C_2H_4COOH$ | $-C_2H_4COOH$ |

A-16

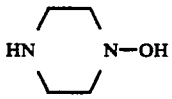

A-17

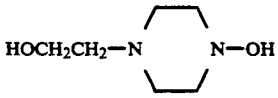

A-18

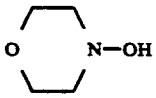

A-19

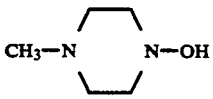

| Exemplified Compound Number | $R_{11}$ | $R_{12}$ |
|---|---|---|
| A-20 | $-CH_3$ | $-C_2H_4OCH_3$ |
| A-21 | $-C_2H_4OCH_3$ | $-C_2H_4OCH_3$ |
| A-22 | $-C_2H_4OC_2H_5$ | $-C_2H_4OC_2H_5$ |
| A-23 | $-C_3H_6OCH_3$ | $-C_3H_6OCH_3$ |
| A-24 | $-C_2H_5$ | $-C_2H_4OC_2H_5$ |
| A-25 | $-C_3H_7$ | $-C_2H_4OCH_3$ |
| A-26 | $-CH_3$ | $-C_2H_4OC_2H_5$ |
| A-27 | $-CH_3$ | $-CH_2OCH_3$ |
| A-28 | $-C_2H_5$ | $-CH_2OC_2H_5$ |
| A-29 | $-CH_2OCH_3$ | $-CH_2OCH_3$ |
| A-30 | $-C_2H_5$ | $-C_2H_4OC_3H_7$ |

-continued

| | | |
|---|---|---|
| A-31 | $-C_3H_6OC_3H_7$ | $-C_3H_6OC_3H_7$ |
| A-32 | 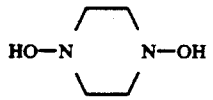 | |
| A-33 | 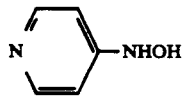 | |
| A-34 | 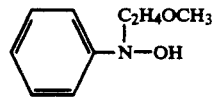 | |
| A-35 | 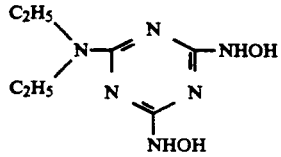 | |
| A-36 | $CH_3CO-NHOH$ | |
| A-37 | $C_4H_9O-\underset{\underset{O}{\parallel}}{C}-NHOH$ | |
| A-38 | 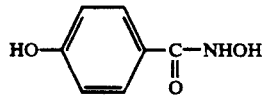 | |
| A-39 | $H_2N-\underset{\underset{O}{\parallel}}{C}-NHOH$ | |

| Exemplified compound number | $R_{11}$ | $R_{12}$ |
|---|---|---|
| A-40 | $-CH_2CH_2SO_3H$ | $-CH_2CH_2SO_3H$ |
| A-41 | $-CH_2CH_2PO_3H_2$ | $-CH_2CH_2PO_3H_2$ |
| A-42 | $-H$ | $-CH_2CH_2OH$ |
| A-43 | $-H$ | $-CH_2CH_2SO_3H$ |

The compound represented by the formula B is described below.

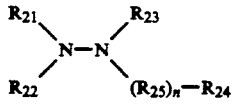

Formula B where $R_{21}$, $R_{22}$ and $R_{23}$ independently represent a hydrogen atom, an alkyl group, aryl group or heterocyclic group, which may have a substituent; $R_{24}$ represents a hydroxyl group, hydroxyamino group, alkyl group, aryl group, heterocyclic group, alkoxy group, aryloxy group, carbamoyl group or amino group, the above alkyl group, aryl group, heterocyclic group, alkoxy group, aryloxy group, carbamoyl group and amino group each may have a substituent, and the heterocyclic group is 5- or 6-membered ones, which may be saturated or unsaturated, composed of atoms selected from a carbon atom, hydrogen atom, oxygen atom, nitrogen atom and sulfur atom; $R_{25}$ represent a —CO— group, $—SO_2—$ group or

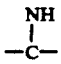

group; n is an integer of 0 or 1; $R_{24}$ preferably represent an alkyl group, aryl group or heterocyclic group when n is 0; $R_{13}$ and $R_{24}$ may be bonded together with to form a ring.

With respect to the formula B, $R_{21}$, $R_{22}$ and $R_{23}$ preferably represent a hydrogen atom or an alkyl group having a carbon number of 1 to 10, with most preference given to a hydrogen atom for $R_{21}$ and $R_{22}$.

$R_{24}$ represents an alkyl group, aryl group, carbamoyl group or amino group, with preference given to an alkyl group and substituted alkyl group. Examples of preferable substituents for the alkyl group include a carboxyl group, sulfo group, nitro group, amino group and phosphono group.

Examples of the compound represented by the formula B are given below.

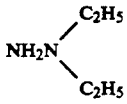 B-1

$NH_2NH(CH_2)_4SO_3H$ B-2

$NH_2NH(CH_2)_2OH$ B-3

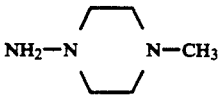 B-4

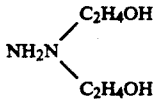 B-5

$NH_2NHCOCH_3$ B-6

$NH_2NHCOOC_2H_6$ B-7

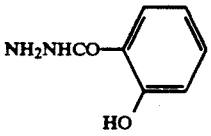 B-8

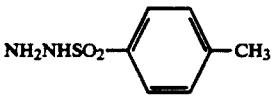 B-9

$NH_2NHCONH_2$ B-10

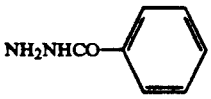 B-11

$NH_2NHSO_3H$ B-12

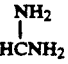 B-13

$NH_2NHCOCONHNH_2$ B-14

$NH_2NHCH_2CH_2CH_2SO_3H$ B-15

-continued

B-16 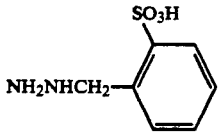

B-17 $NH_2NHCHCOOH$ (with $C_4H_9(n)$)

B-18 $NH_2NHCH_2CH_2COOH$

B-19 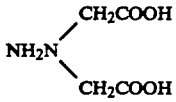

B-20 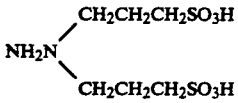

B-21 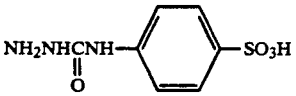

B-22 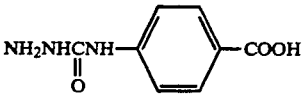

B-23 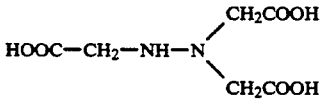

B-24 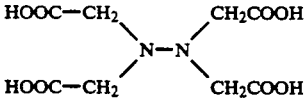

B-25 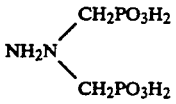

B-26 $HOOCCH_2NHNHCH_2COOH$

B-27 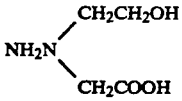

B-28 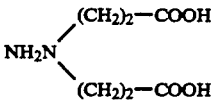

B-29 $H_2NNHCHCOOH$ (with $C_6H_{13}(n)$)

B-30 $H_2NN(CHCOOH)_2$ (with $C_4H_8(n)$)

B-31 $H_2NN(CH_2CH_2SO_3H)_2$

B-32 $H_2NN(CHCOOH)_2$ (with $C_2H_5$)

-continued

B-33 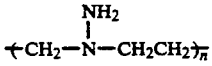

Average molecular weight = about 4000

These compounds represented by the formula A or B are used usually in the forms of free amine, hydrochloride, sulfate, p-toluenesulfonate, oxalate, phosphate, acetate.

The concentration of the compound represented by the above formula A or B in the color developer is usually 0.4 to 100 g/l, preferably 1.0 to 60 g/l, and still more preferably 2 to 30 g/l.

Of these exemplified compounds represented by the formula A or B, A-1, A-2, A-10, A-13, A-14, A-15, A-18, A-21, A-40, A-41, B-5, B-19 and B-20 are preferably used, with more preference given to those compounds which are highly soluble in water, i.e., A-13, A-14, A-15, A-18, A-21, A-40, A-41, B-19 and B-20.

Although the compound represented by the formula A or B may be used in combination with conventionally used hydroxylamine and various organic preservatives, it is preferable from the viewpoint of developability to avoid the use of hydroxylamine.

These compounds represented by the formula A or B may be used singly or in combination.

It is preferable that the color developer of the present invention contain a chloride at a concentration within a given range. The chloride for the invention may be any compound, as long as it releases chloride ions in the color developer. Examples of such compounds include potassium chloride, sodium chloride, lithium chloride and magnesium chloride.

The desired effect of the invention is enhanced when the chloride concentration in the color developer is at least $3\times10^{-2}$ mol per liter of color developer, more preferably $3.5\times10^{-2}$ to $20\times10^{-2}$ mol per liter of color developer, and still more preferably $4.0\times10^{-2}$ to $12\times10^{-2}$ mol per liter of color developer.

The color developer usually incorporates a sulfite as a preservative. When the color developer contains a sulfite at a concentration not more than $1.6\times10^{-2}$ mol per liter of color developer, the developer permits rapid processing of a light-sensitive material based mainly on silver chloride since coloring density reduction, attributable to the physical dissolution of the light-sensitive material based mainly on silver chloride, can be suppressed, and the degradation in the preserving performance is very slight; it is therefore preferable to use a sulfite at concentrations not more than $1.6\times10^{-2}$ mol/l. This effect is enhanced at concentrations not more than $1\times10^{-2}$ mol/l, and more preferably not more than $4\times10^{-3}$ mol/l.

Examples of the sulfite include sodium sulfite, potassium sulfite, sodium bisulfite and potassium bisulfite.

The compound represented by the following formula D is preferably used in the color developer of the invention since it not only enhances the effect of the invention but also serves to prevent the air oxidation of the color developer.

Formula D

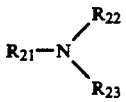

wherein $R_{21}$ represents a hydroxylalkyl group having a carbon number of 2 to 6; $R_{22}$ and $R_{23}$ independently represent a hydrogen atom, an alkyl group having a carbon number of 1 to 6, a carboxymethyl group, hydroxylalkyl group having a carbon number of 2 to 6, benzyl group or

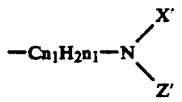

in which $n_1$ represents an integer of 1 to 6; X' and Y' independently represent a hydrogen atom, an alkyl group having 1 to 6 carbon atoms or a hydroxylalkyl group having 2 to 6 carbon atoms.

The compound represented by the above formula D is preferably exemplified as follows:

D-1: Ethanolamine
D-2: Diethanolamine
D-3: Triethanolamine
D-4: Diisopropanolamine
D-5: 2-methylaminoethanol
D-6: 2-ethylaminoethanol
D-7: 2-dimethylaminoethanol
D-8: 2-diethylaminoethanol
D-9: 1-diethylamino-2-propanol
D-10: 3-diethylamino-1-propanol
D-11: 3-dimethylamino-1-propanol
D-12: Isopropylaminoethanol
D-13: 3-amino-1-propanol
D-14: 2-amino-2-methyl-1,3-propanediol
D-15: Ethylenediaminetetraisopropanol
D-16: Benzyldiethanolamine
D-17: 2-amino-2-(hydroxymethyl)-1,3-propanediol
D-18: Dihydroxyethylglycine
D-19: Hydroxyethyliminodiacetic acid From the viewpoint of the desired effect of the present invention, the compound represented by the formula D is preferably used at 1 to 100 g, more preferably 3 to 50 g per liter of color developer. A commonly used chelating agent is preferably added to the color developer of the present invention. The chelating agent represented by the following formula E is preferably used, since it enhances the preservability and has a development accelerating effect.

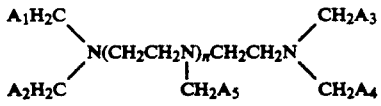

Formula E where $A_1$ through $A_5$, whether identical or not, independently represent —$COOM_1$ or —$PO_3M_2M_3$. $M_1$, $M_2$ and $M_3$, whether identical or not, independently represent a hydrogen atom, alkali metal atom or ammonium ion; n represents 1 or 2.

Examples of the compound represented by the Formula E include diethylenetriaminepentaacetic acid, triethylenetetraminehexaacetic acid, diethylenetriaminepentamethylenephosphonic acid and triethylenetetraminehexamethylenephosphonic acid and salts thereof such as those with alkali metals such as potassium, sodium and lithium and ammonium salts, which are commercially available.

These compounds represented by the formula E are preferably used in the content range of from 0.1 to 20 g, more preferably 0.5 to 10 g, and ideally 1 to 5 g per liter of color developer.

Of the compounds represented by the formula E, diethylenetriaminepentaacetic acid and its salt are preferred from the viewpoint of the desired effect of the invention.

The pH of the color developer is usually 9.0 to 12.0, preferably 10.0 to 11.0.

In the present invention, color development is normally followed by processing with a processing solution capable of bleaching.

The bleaching agent used in the bleacher or bleach-fixer used as a processing solution capable of bleaching is a metal complex salt of organic acid, which metal complex salt oxidizes the metal silver formed upon development to silver halide. The complex salt is obtain by complex formation of an organic acid such as aminopolycarboxylic acid, oxalic acid or citric acid with a metal ion such as iron, cobalt or copper ion.

The most preferable organic acid for the formation of such a metal complex salt of organic acid is polycarboxylic acid or aminopolycarboxylic acid. The polycarboxylic acid or aminopolycarboxylic acid may be an alkali metal salt, ammonium salt or water-soluble amine salt.

Examples of these organic acids are given below.

(1) Ethylenediaminetetraacetic acid
(2) Diethylenetriaminepentaacetic acid
(3) Ethylenediamine-N-(β-oxyethyl)-N,N',N'-triacetic acid
(4) 1,3-propylenediaminetetraacetic acid
(5) Nitrilotriacetic acid
(6) Cyclohexanediaminetetraacetic acid
(7) Iminodiacetic acid
(8) Dihydroxyethylglycinecitric acid
(9) Ethyl ether diaminetetraacetic acid
(10) Glycol ether diaminetetraacetic acid
(11) Ethylenediaminetetrapropionic acid
(12) Phenylenediaminetetraacetic acid The bleacher used may contain various additives in addition to metal complex salts of organic acid as bleaching agents. It is preferable to add alkali halide or ammonium halide as re-halogenating agents such as potassium bromide, sodium bromide, sodium chloride and ammonium bromide, metal salts, chelating agents, nitrate and commonly known bleaching accelerators. Also, pH buffers such as borate, oxalate, acetate, carbonate and phosphate, alkylamines, polyethylene oxides and other additives which are known as additives to bleacher may be appropriately added.

In addition, the bleacher and bleach-fixer may contain one or more pH buffers comprising a sulfite such as ammonium sulfite, potassium sulfite, sodium bisulfite, ammonium metabisulfite, potassium metabisulfite or sodium metabisulfite, or various acids and salts such as boric acid, borax, sodium hydroxide, potassium hydroxide, sodium carbonate, potassium carbonate, sodium bicarbonate, potassium bicarbonate, acetic acid, sodium acetate and ammonium hydroxide.

In the present invention, to increase the activity of the bleacher or bleach-fixer, air or oxygen sparging may be carried out as necessary in the bleaching bath or bleach-fixing bath and in the bleacher replenisher or bleach-fixer replenisher storage tank, or an appropriate oxidant such as hydrogen peroxide, hydrobromide or persulfate may be appropriately added.

The pH of the bleacher relating to the present invention is usually 2.5 to 6.5, and preferably 3.0 to 5.0.

The pH of the fixer relating to the present invention is usually 5.0 to 8.0, and preferably 5.5 to 7.5.

In the present invention, from the viewpoint of rapid processing, a bleach-fixer is preferably used. Since stain known as bleach fogging is likely to occur when a light-sensitive material based mainly on silver chloride is subjected to bleach fixation immediately after color development as in the invention, it is preferable to use the bleach-fixer in the pH range between 4.5 and 6.8.

In the processing method of the present invention, stabilization may be carried out without washing after bleaching and fixation or bleach-fixation after color development, and stabilization may follow washing. In addition to these processes, hardening, neutralization, black-and-white development, reversion, prewashing, and other known auxiliary processes may be added as necessary. Typical examples of preferred processing methods include the following procedures:

(1) Color development→bleach-fixation→washing
(2) Color development→bleach-fixation→prewashing →washing
(3) Color development→bleach-fixation→washing→ stabilization
(4) Color development→bleach-fixation→stabilization
(5) Color development→bleach-fixation→first stabilization→second stabilization
(6) Color development→washing or stabilization→ bleach-fixation -->washing or stabilization
(7) Color development→stopping→bleach-fixation→ washing or stabilization
(8) Color development→bleaching→washing→fixation→washing→stabilization
(9) Color development→bleaching→fixation→washing→stabilization
(10) Color development→bleaching→prewashing→fixation→stabilization
(11) Color development→bleaching→prewashing→fixation→prewashing→washing→stabilization
(12) Color development→prewashing→bleaching→ prewashing→fixation→prewashing→washing→ stabilization
(13) Color development→stopping→bleaching→ prewashing→fixation→prewashing→washing→ stabilization
(14) Color development→bleaching→fixation→stabilization Of these processes, the process 4 or 14 is preferably used.

Another preferred mode of the embodiment of the processing method of the invention is the method in which a part or all of the overflow from the color developer of the invention is allowed to enter in the bleacher or bleach-fixer in the procedure which follows. In this method, sludge formation in the bleacher or bleach-fixer is suppressed and the efficiency of silver recovery from the bleach-fixer is improved when a given amount of the color developer of the invention is allowed to enter in the bleacher or bleach-fixer.

The effect described above is enhanced when a part or all of the overflow from the stabilizer in the procedure which follows is allowed to enter in the bleach-fixer or fixer.

The silver halide grains used in the silver halide emulsion layer of the light-sensitive material to be processed by the processing method of the present invention need to have a silver chloride content of over 50 mol%, preferably over 80 mol%, more preferably over 90 mol%, still more preferably over 95 mol%, and ideally over 98 mol%. The total amount of silver coated should be not less than 2 g/m$^2$, preferably 3 to 12 g/m$^2$, and more preferably 4 to 9 g/m$^2$.

The component other than silver chloride is preferably silver bromide or silver iodide, and the silver halide emulsion includes silver chlorobromide, silver chloride and silver chloroiodobromide.

When the silver halide emulsion of the invention comprises crystals of solid solution such as silver chlorobromide or silver chloroiodobromide, the silver bromide or silver iodide is preferably localized in a given site in the silver halide grain crystal.

When the silver halide grains of the invention comprise silver chlorobromide, the silver bromide is preferably localized on, or near, a vertex of the silver halide crystal. Such a silver halide emulsion can be obtained by adsorbing a sensitizing dye or inhibitor on the silver chloride or silver chlorobromide grain crystal and then carrying out ripening in the presence of fine grains of silver bromide or by halogen substitution in the presence of a solution of a water-soluble bromide.

When the silver halide grains comprise silver chloroiodobromide, the silver iodide is preferably localized in the grains.

A silver halide emulsion wherein silver iodide is localized in the grains can be obtained by depositing silver chloride or silver chlorobromide on a core containing silver iodide. Deposition of silver chloride or silver chlorobromide can be achieved by a known silver halide crystal growth method such as the double jet method and the Ostwald ripening method.

The silver iodide content of the core is preferably not less than 10 mol%, more preferably 15 to 40 mol%.

The core preferably comprises silver iodobromide.

The silver halide emulsion described above can be prepared by the methods described in Japanese Patent O.P.I. Publication Nos. 6941/1989, 26839/1989, 121848/1989 and 138550/1989.

When the silver halide grains of the present invention contain silver iodide, its content to the total grain content is preferably not more than 20 mol%, more preferably not more than 12 mol%, and still more preferably 0 to 5 mol%.

The silver halide grains of the present invention may be of a regular crystal such as a cubic, dodecahedral or octahedral crystal, or may be of a twin crystal such as a tabular twin crystal. The crystal configuration can be controlled by selecting an appropriate combination of pAg, pH and other factors in mixing. Octahedral or tabular grains can be obtained by making silver halide grains to undergo crystal growth in the presence of an adsorptive sensitizing dye or inhibitor as described in Japanese Patent O.P.I. Publication Nos. 11935/1983, 11936/1983, 11937/1983, 108528/1983, 163046/1987, 41845/1988 and 212932/1988.

The average grain diameter of the silver halide grains of the present invention is preferably 0.05 to 10 μm, more preferably 0.1 to 5 μm, and ideally 0.2 to 3 μm.

The localization of halogen in silver halide grains can be confirmed by X-ray diffraction analysis and by X-ray microanalysis on sections of silver halide grains in dispersion in resin.

The silver halide emulsion of the present invention is preferably monodispersed.

A highly monodispersed emulsion preferred for the present invention has a distribution width of not more than 20%, more preferably not more than 15%, as defined as follows:

$$\frac{\text{Grain size standard deviation}}{\text{Average grain size}} \times 100 = \text{distribution width (\%)}$$

Here, grain size is measured by the method described above, and the average grain size is expressed in arithmetic mean.

$$\text{Average grain size} = \frac{\Sigma d_1 n_1}{\Sigma n_1}$$

wherein $n_1$ is number of grains having the diameter of L.

The grain diameter in this context is the diameter of a circle converted from a grain projection image with the same area.

Grain size can be obtained by measuring the diameter of the grain or the area of projected circle on an electron micrograph taken at $\times$10000 to 50000 (the number of subject grains should be not less than 1000 randomly).

In the silver halide color photographic light-sensitive material to be processed by the method of the present invention, the silver halide emulsions described in Research disclosure No. 308119 (hereinafter referred to as RD308119) can be used in addition to the silver halide emulsion of the invention.

The silver halide emulsion is used after physical ripening, chemical ripening and spectral sensitization. Additives used in these processes are described in Research Disclosure Nos. 17643, 18716 and 308119.

Known photographic additives which can be used for the light-sensitive material processed by the method of the present invention are also described in the above Research Disclosure numbers.

The present invention may contain various couplers. Examples thereof are also described in the above Research Disclosure Numbers.

The additives used for the present invention can be added by dispersion as described in RD308119XIV and by other methods.

In the present invention, the supports described in RD17643, p. 28, RD18716, pp. 647–648 and RD308119 XIX.

The light-sensitive material to be processed by the method of the present invention may be provided with auxiliary layers such as filter layers and interlayers as described in RD308119, VII-Term K.

The light-sensitive material can take various layer configurations such as the ordinary, reverse and unit structures described in RD308119, VII-Term K.

The desired effect of the invention is enhanced when the light-sensitive material contains a magenta coupler represented by the following formula M-1.

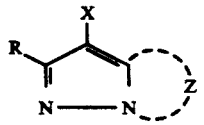

wherein Z represents a group of non-metallic atoms necessary to form a nitrogen-containing heterocyclic ring, which ring may have a substituent.

X represents a hydrogen atom or a group capable of splitting off upon reaction with the oxidation product of a color developing agent.

R represents a hydrogen atom or substituent.

The substituent represented by R is not subject to limitation. Typical examples thereof include alkyl, aryl, anilino, acylamino, sulfonamide, alkylthio, arylthio, alkenyl and cycloalkyl groups, and halogen atoms, cycloalkenyl, alkynyl, heterocyclic, sulfonyl, sulfinyl, phosphonyl, acyl, carbamoyl, sulfamoyl, cyano, alkoxy, aryloxy, heterocyclic oxy, siloxy, acyloxy, carbamoyloxy, amino, alkylamino, imido, ureide, sulfamoylamino, alkoxycarbonylamino, aryloxycarbonylamino, akloxycarbonyl, aryloxycarbonyl and heterocyclic thio groups, and spiro compound residues and bridged hydrocarbon compound residues.

The alkyl group represented by R preferably has 1 to 32 carbon atoms, whether linear or branched.

The aryl group represented by R is preferably a phenyl group.

Examples of the acylamino group represented by R include alkylcarbonylamino groups and arylcarbonylamino groups.

Examples of the sulfonamide group represented by R include alkylsulfonylamino groups and arylsulfonylamino groups.

The alkyl moiety and aryl moiety in the alkyl thio group and arylthio group represented by R include the alkyl groups and aryl groups represented by R.

The alkenyl group represented by R preferably has 2 to 32 carbon atoms. The cycloalkyl group represented by R preferably has 3 to 12 particularly 5 to 7 carbon atoms. The alkenyl group may be linear or branched.

The cycloalkenyl group represented by R preferably has atoms 3 to 12, particularly 5 to 7 carbon atoms.

Examples of the sulfonyl group represented by R include alkylsulfonyl groups and arylsulfonyl groups.

Examples of the sulfinyl group represented by R include alkylsulfinyl groups and arylsulfinyl groups.

Examples of the phosphonyl group represented by R include alkylphosphonyl groups, alkoxyphosphonyl groups, arylphosphonyl groups and arylphosphonyl groups.

Examples of the acyl group represented by R include alkylcarbonyl groups and arylcarbonyl groups.

Examples of the carbamoyl group represented by R include alkylcarbamoyl groups and arylcarbamoyl groups.

Examples of the sulfamoyl group represented by R include alkylsulfamoyl groups and arylsulfamoyl groups.

Examples of the acyloxy group represented by R include alkylcarbonyloxy groups and arylcarbonyloxy groups.

Examples of the carbamoyloxy group represented by R include alkylcarbamoyloxy groups and arylcarbamoyloxy groups.

Examples of the ureide group represented by R include alkylureide groups and arylureide groups.

Examples of the sulfamoylamino group represented by R include alkylsulfamoylamino groups and arylsulfamoylamino groups.

The heterocyclic group represented by R is preferably a 5- to 7-membered ring, including a 2-furyl group, 2-thienyl group, 2-pyrimidinyl group and 2-benzothiazolyl group.

The heterocyclic oxy group represented by R preferably has a 5- to 7-membered heterocyclic ring, including a 3,4,5,6-tetrahydropyranyl-2-oxy group and 1-phenyltetrazole-5-oxy group.

The heterocyclic thio group represented by R is preferably a 5- to 7-membered heterocyclic thio group, including a 2-pyridylthio group, 2-benzothiazolylthio group and 2,4-diphenoxy-1,3,5-triazole-6-thio group.

Examples of the siloxy group represented by R include a trimethylsiloxy group, triethylsiloxy group and dimethylbutylsiloxy group.

Examples of the imide group represented by R include an succinimide group, 3-heptadecylsuccinimide group, phthalimide group and glutarimide group.

Examples of the spiro compound residue represented by R include spiro[3.3]heptan-1-yl.

Examples of the bridged hydrocarbon compound residue represented by R include bicyclo[2.2.1]heptan-1-yl, tricyclo[3.3.1.1$^{3,7}$]decan-1-yl and 7,7-dimethylbicyclo[2.2.1]heptan-1-yl.

Examples of the group capable of splitting off upon reaction with the oxidation product of a color developing agent, represented by X, include halogen atoms such as those of chlorine, bromine and fluorine, and alkoxy, aryloxy, heterocyclic oxy, acyloxy, sulfonyloxy, alkoxycarbonyloxy, aryloxycarbonyl, alkyloxyaryloxy, alkoxyoxaryloxy, alkoxythio, arylthio, heterocyclic thio, alkyloxythiocarbonylthio, acylamino, sulfonamide, nitrogen-containing heterocyclic rings bound via nitrogen atom, alkyloxycarbonylamino, aryloxycarbonylamino, carboxyl,

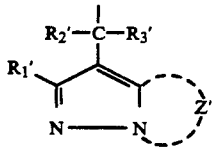

wherein $R_1'$ has the same definition as R above; Z' has the same definition as Z above; $R_2'$ and $R_3'$ represent a hydrogen atom, aryl group, alkyl group or heterocyclic group, with preference given to a halogen atom, particularly an atom of chlorine.

Examples of the nitrogen-containing heterocyclic ring formed by Z or Z' include a pyrazole ring, imidazole ring, triazole ring and tetrazole ring; the substituent which may be bonded to the ring is exemplified by the examples given for R above.

The compound represented by the formula M-I is more specifically represented by the following formulas M-II through M-VII.

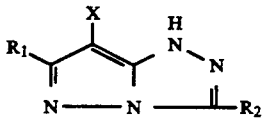

Formula M-II

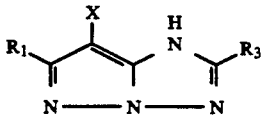

Formula M-III

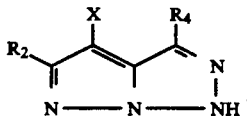

Formula M-IV

-continued

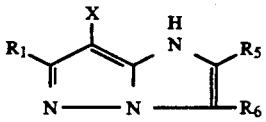

Formula M-V

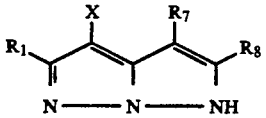

Formula M-VI

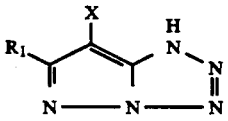

Formula M-VII

With respect to the formulas M-II through M-VII, $R_1$ through $R_8$ and X have the same definitions as R and X above.

The compound represented by the formula M-I is preferably represented by the following formula M-VIII.

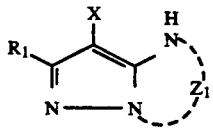

Formula M-VIII wherein $R_1$, X and $Z_1$ have the same definitions as R, X and Z in the formula M-I.

Of the magenta couplers represented by the formulas M-II through M-VII, the magenta coupler represented by the formula M-II is preferred.

The substituent which may be contained in the ring formed by Z in the formula M-I and in the ring formed by $Z_1$ in the formula M-VIII, and $R_2$ through $R_8$ in the formulas M-II through M-VI are preferably represented by the following formula M-IX.

$$-R^1-SO_2-R^2$$

Formula M-IX wherein $R^1$ represents an alkylene group; $R^2$ represents an alkyl group, cycloalkyl group or aryl group.

The alkylene group represented by $R^1$, whether linear or branched, preferably has a carbon number of 2 or more, more preferably 3 to 6 in the linear moiety.

The cycloalkyl group represented by $R^2$ is preferably a 5- or 6-membered ring.

In the formation of positive images, the substituents R and $R^1$ on the heterocyclic ring is most preferably represented by the following formula M-X.

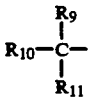

Formula M-X wherein $R_9$, $R_{10}$ and $R_{11}$ have the same definitions as R above.

Two of the $R_9$, $R_{10}$ and $R_{11}$, for example, $R_9$ and $R_{10}$, may bind together to form a saturated or unsaturated ring such as a cycloalkane, cycloalkene or heterocyclic ring, which ring may be bound with $R_{11}$ to form a bridged hydrocarbon compound residue.

With respect to the formula M-X, it is preferable that (i) at least two of $R_9$ through $R_{11}$ are alkyl groups, or (ii) one of $R_9$ through $R_{11}$, for example, $R_{11}$, is a hydrogen atom while the other two, namely $R_9$ and $R_{10}$, bind together to form a cycloalkyl in cooperation with the carbon atom to which $R_9$ and $R_{10}$ are bonded.

With respect to the case (i), it is preferable that two of $R_9$ through $R_{11}$ are alkyl groups while the remaining one is a hydrogen atom or alkyl group.

In the formation of negative images, the substituents R and $R_1$ on the heterocyclic ring is most preferably represented by the following formula M-XI.

$$R_{12}—CH_2— \qquad \text{Formula M-XI}$$

wherein $R_{12}$ has the same definitions as R above.

$R_{12}$ is preferably a hydrogen atom or alkyl group.

Typical examples of the compound of the present invention are given below.

1

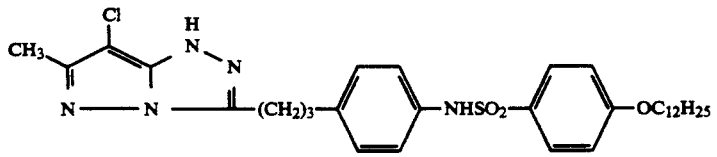

2

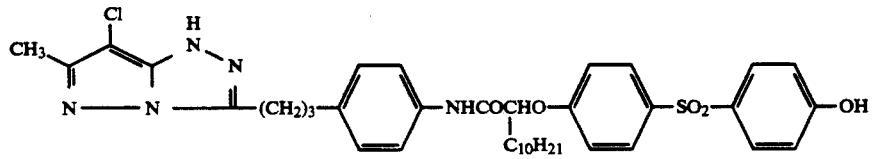

3

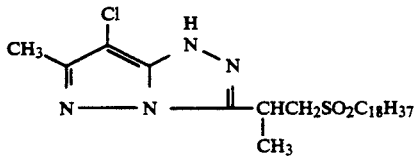

4

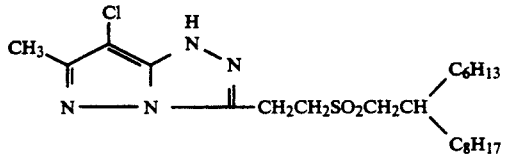

5

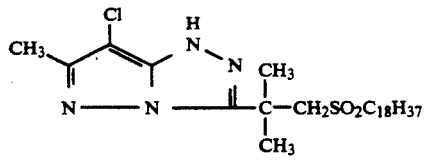

6

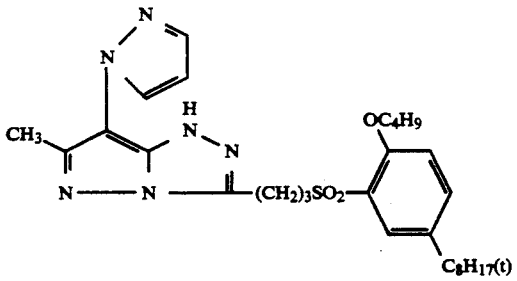

7

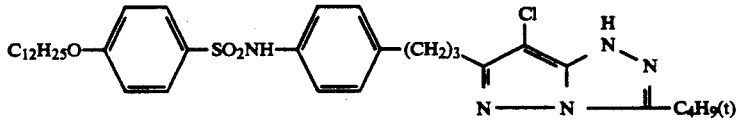

8

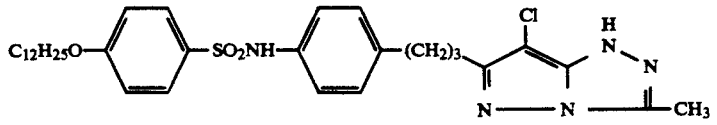

-continued
9
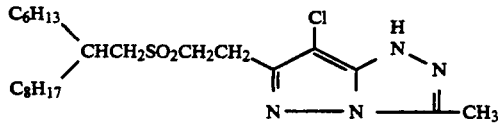
10
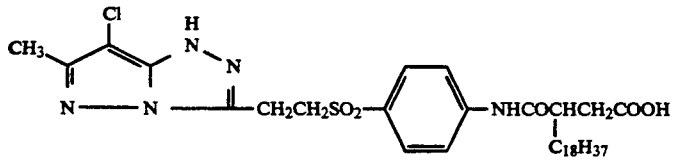
11
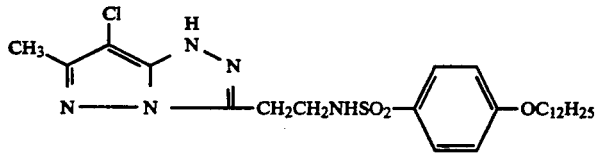
12
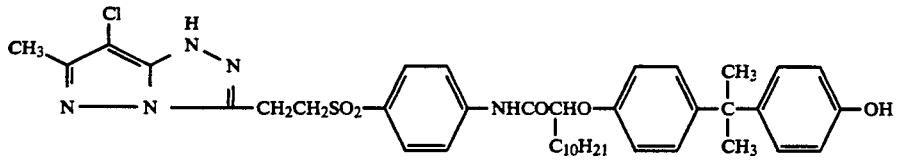
13
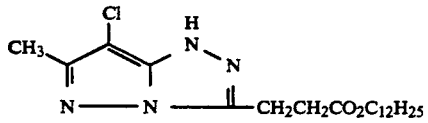
14
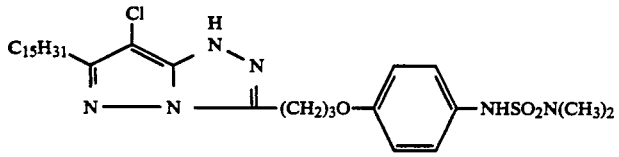
15
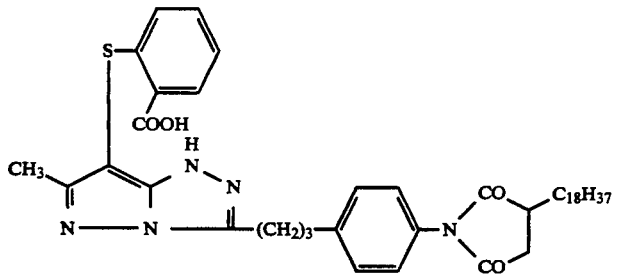
16
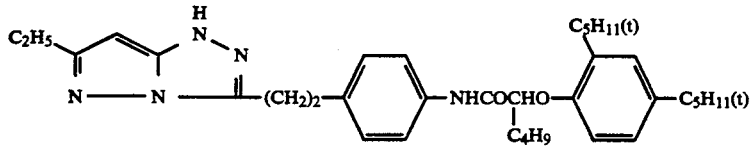
17
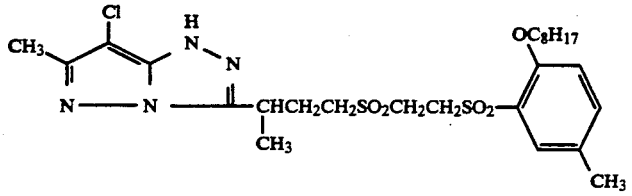

-continued
18
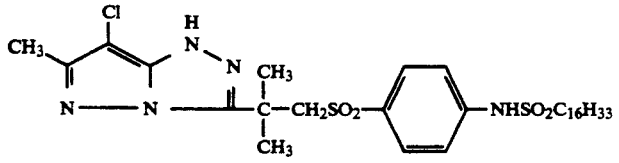
19
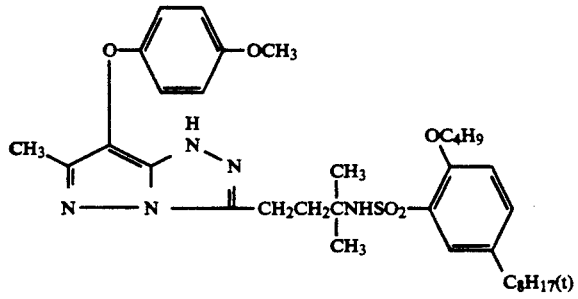
20
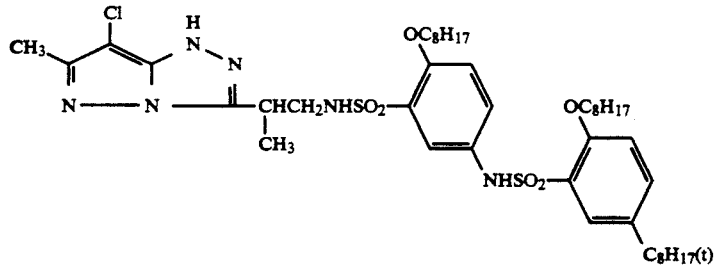
21
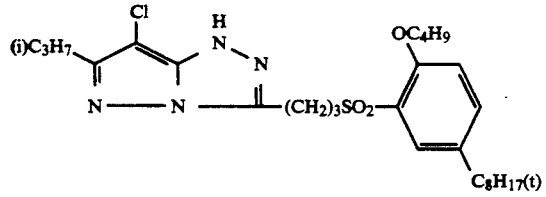
22
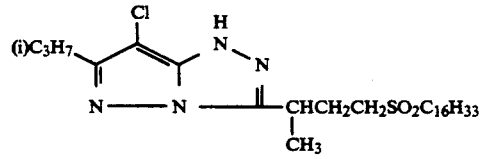
23
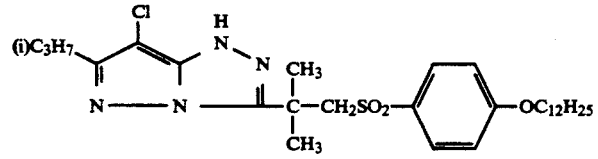
24
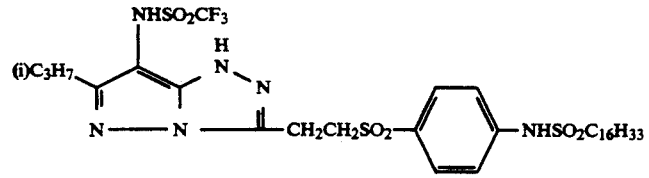

-continued
25
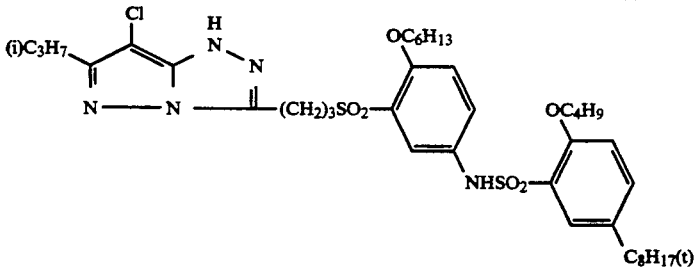
26
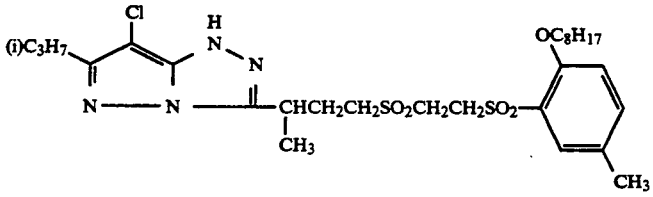
27
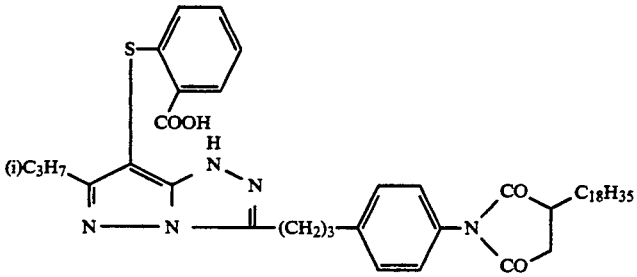
28
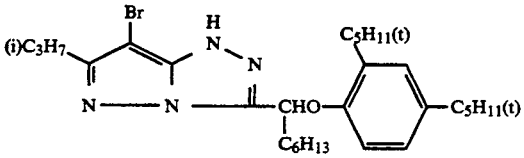
29
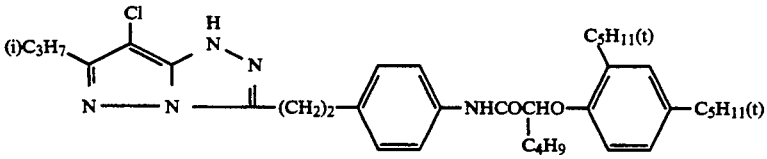
30
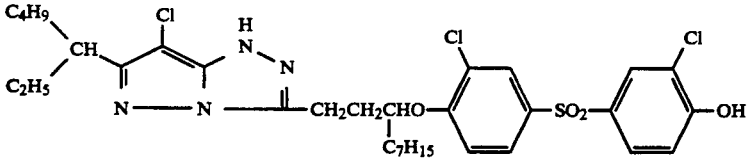
31
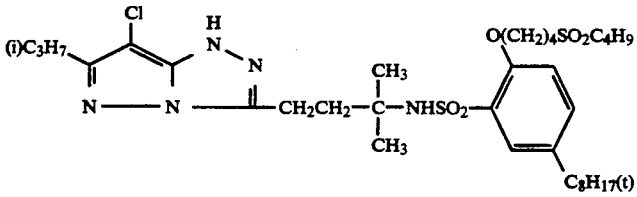
32
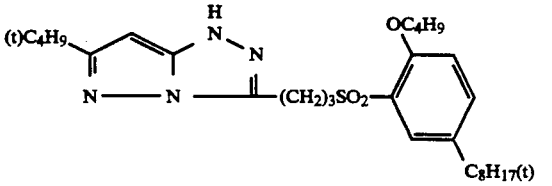

-continued
33
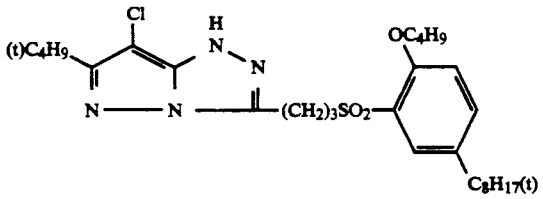
34
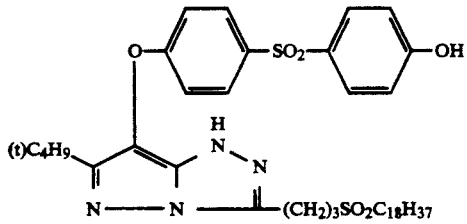
35
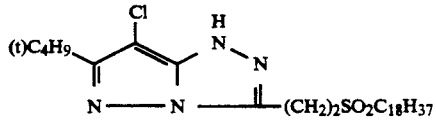
36
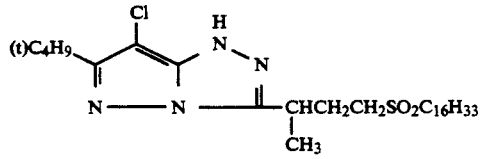
37
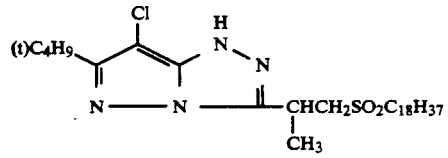
38
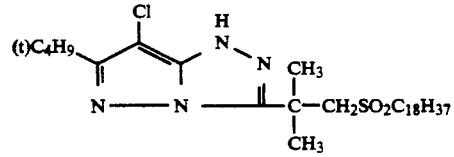
39
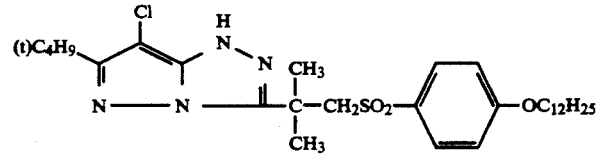
40
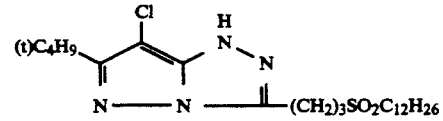
41
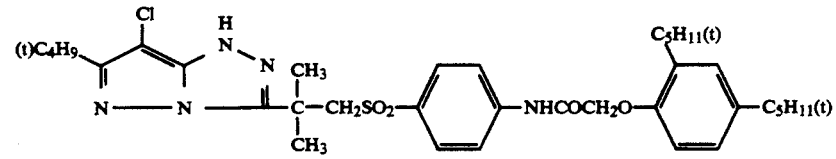

-continued
42
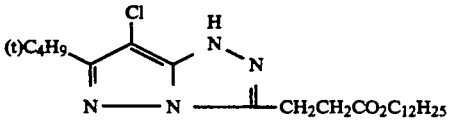
43
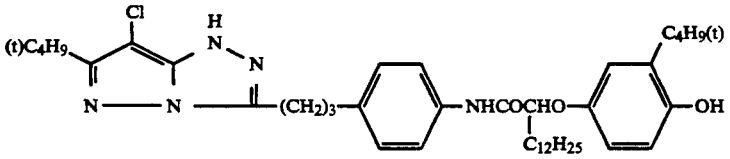
44
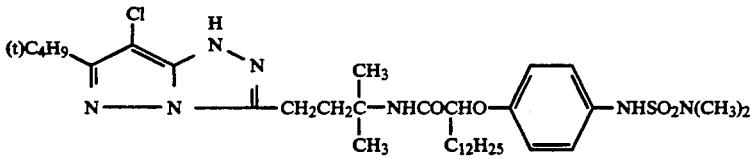
45
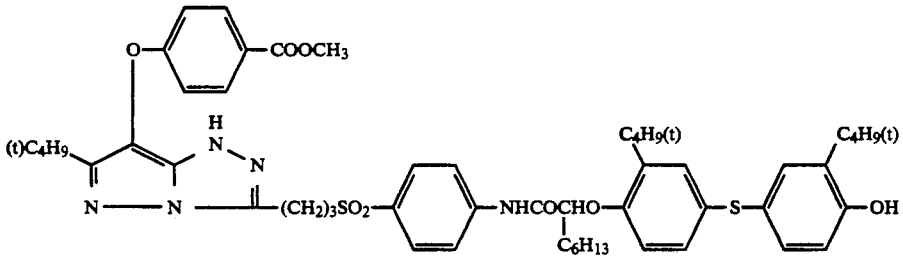
46
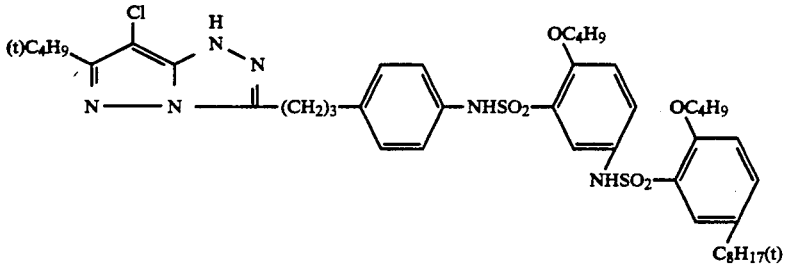
47
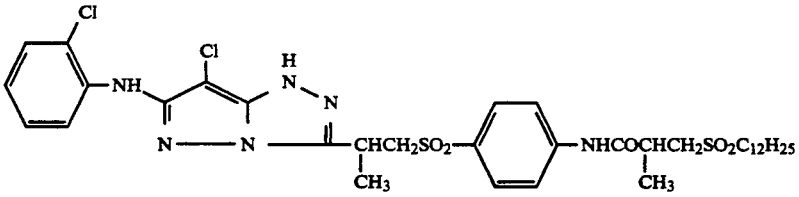
48
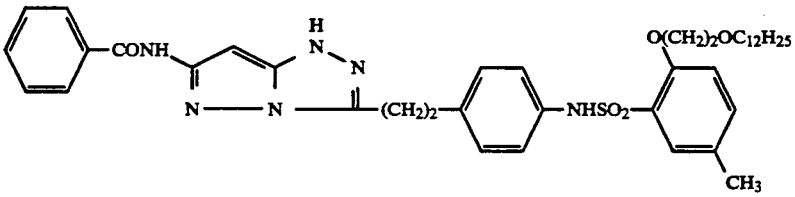
49
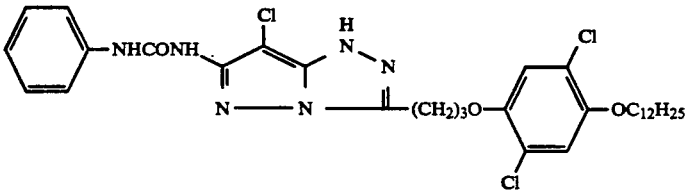

-continued
50
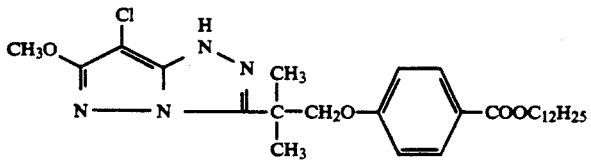
51
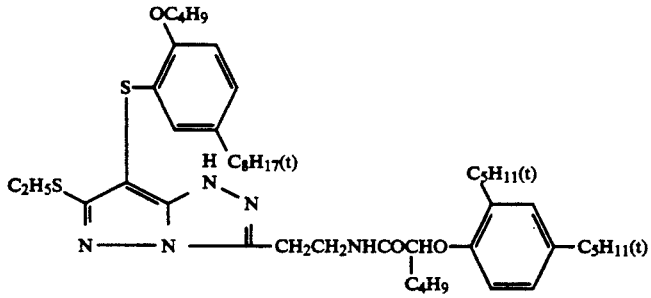
52
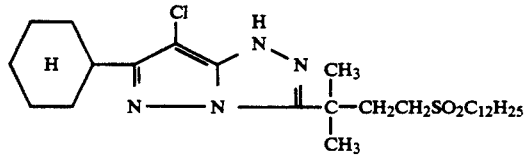
53
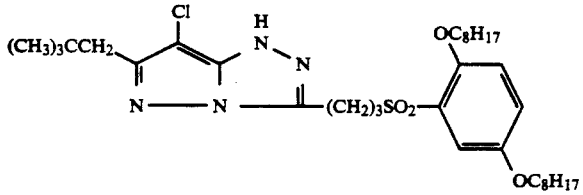
54
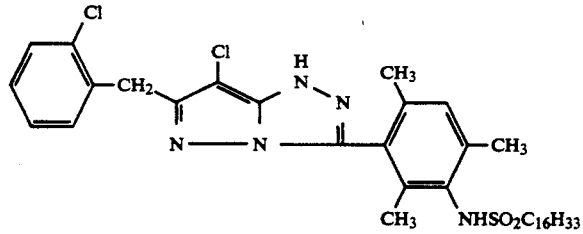
55
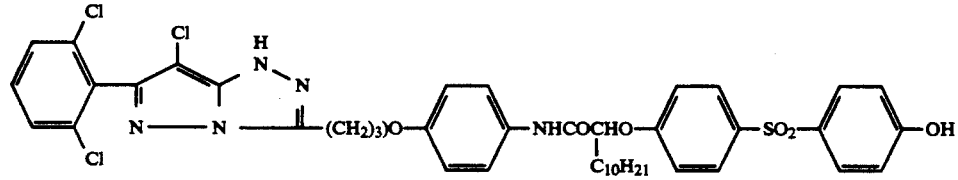
56
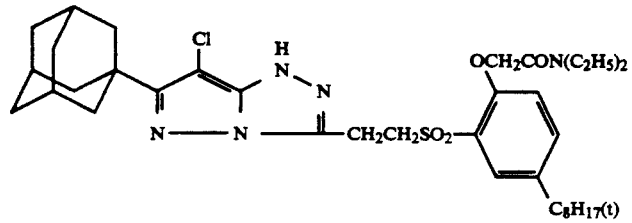

-continued
57
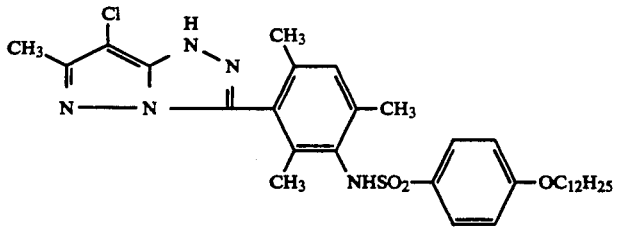
58
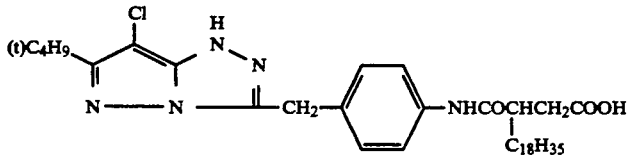
59
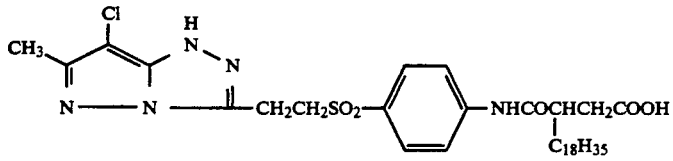
60
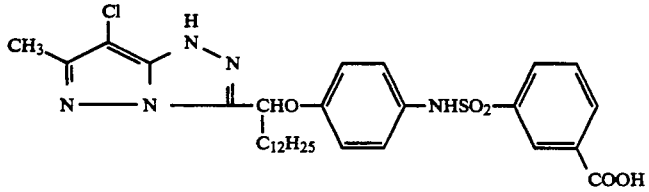
61
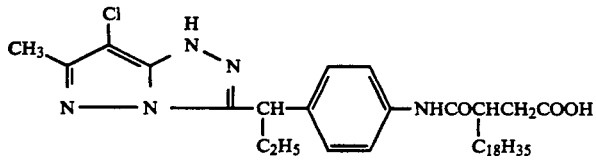
62
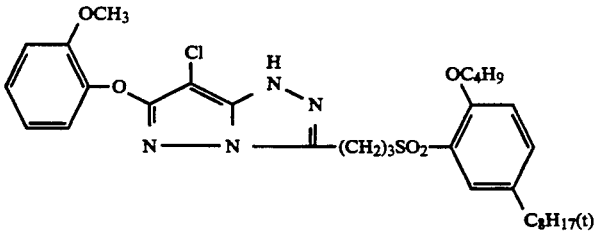
63
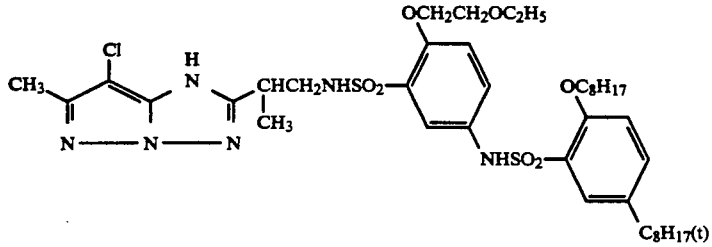

-continued
64
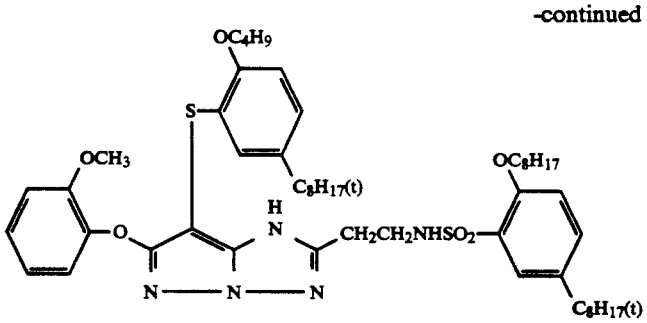
65
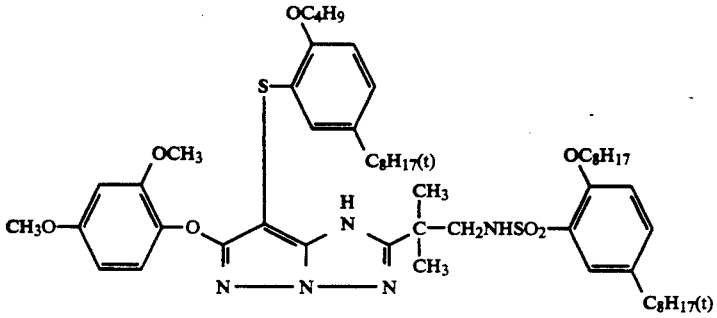
66
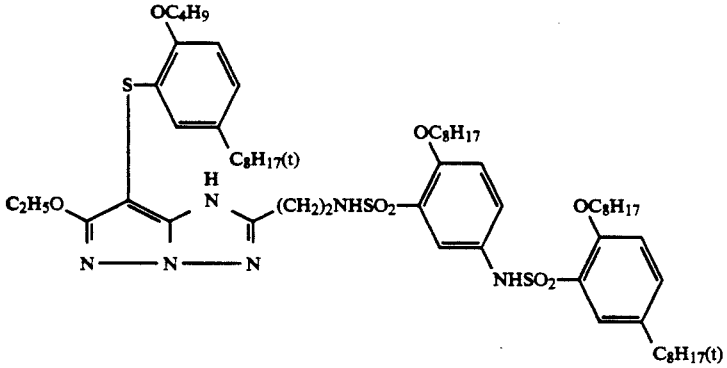
67
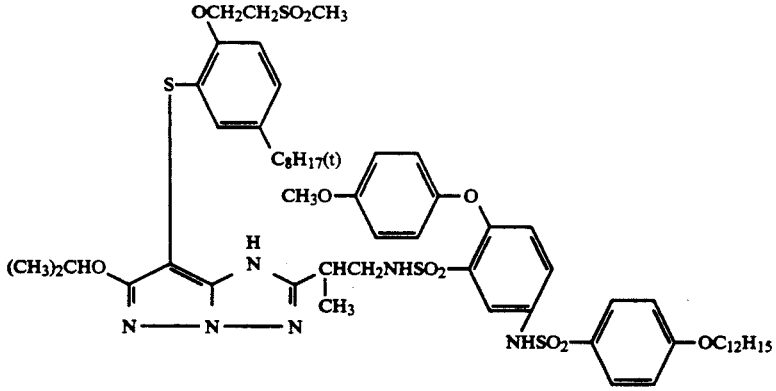
68
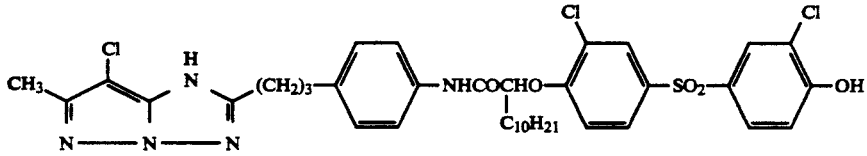
69
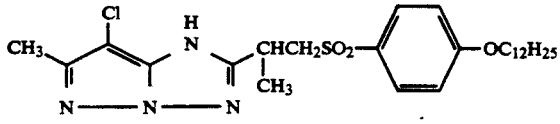

-continued
70
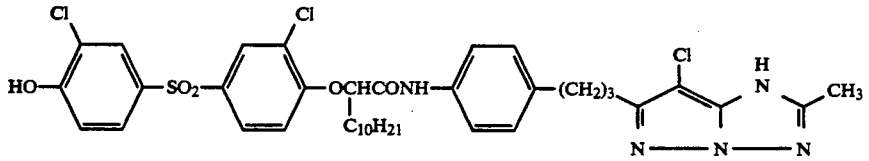
71
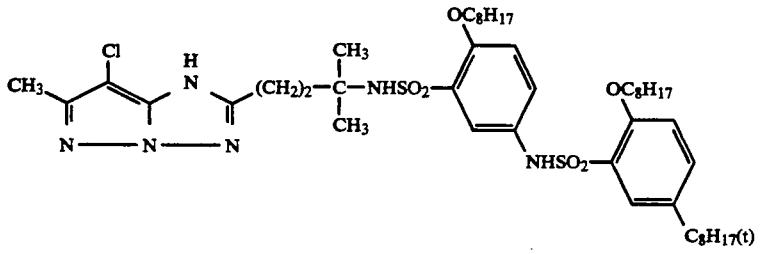
72
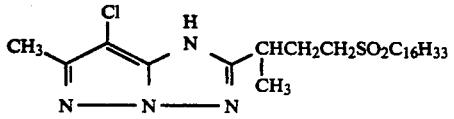
73
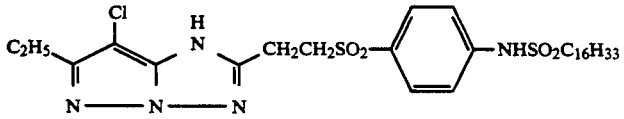
74
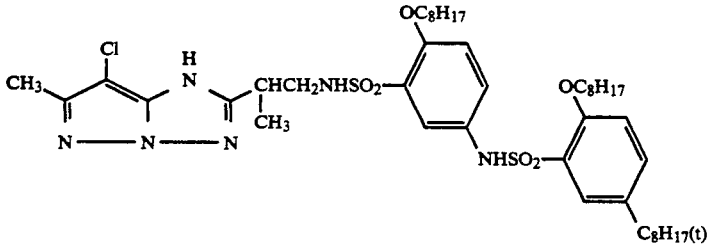
75
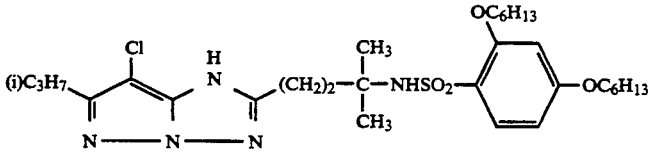
76
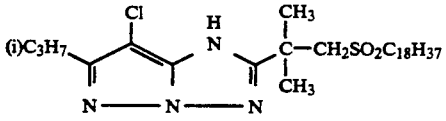
77
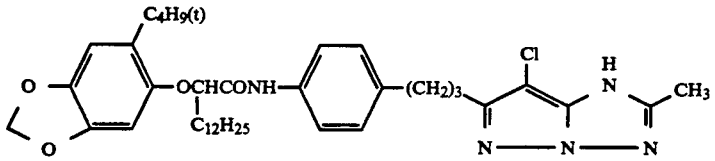
78
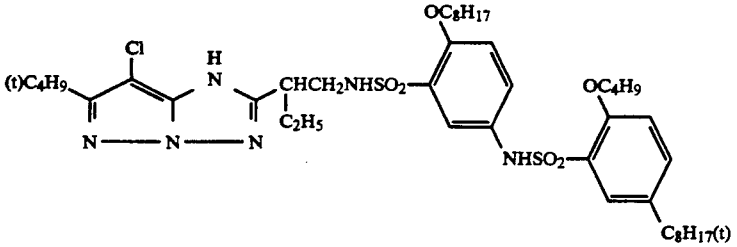

-continued
79
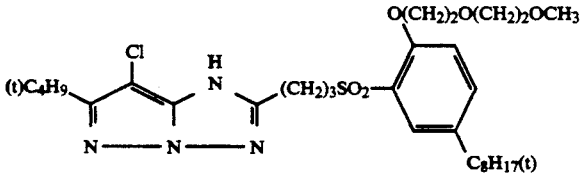
80
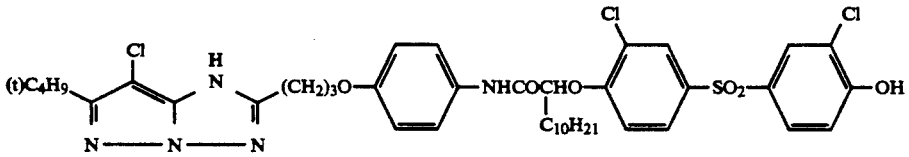
81
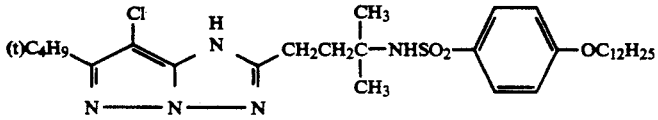
82
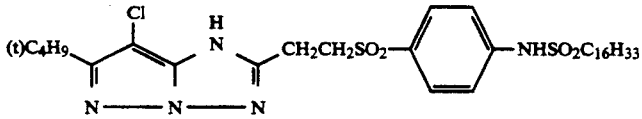
83
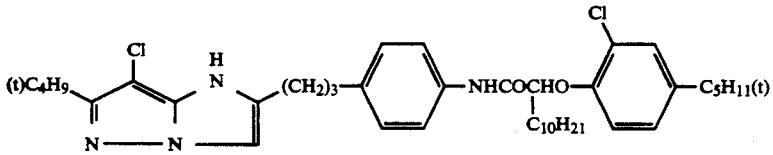
84
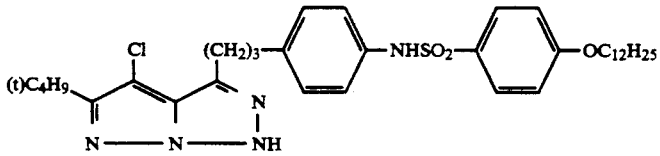
85
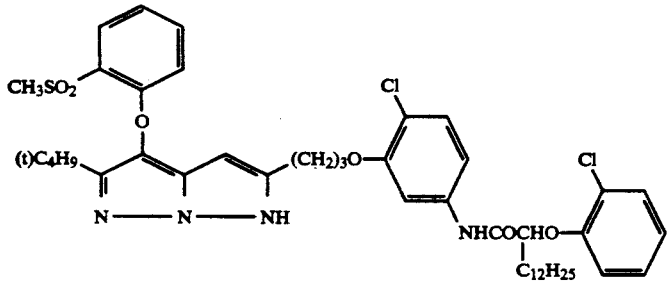
86
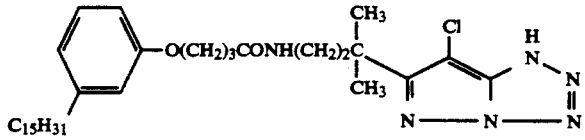

-continued

87

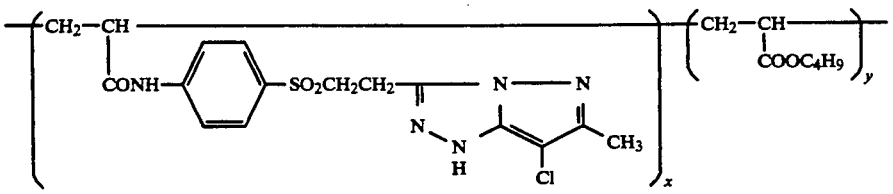

x:y = 50:50

88

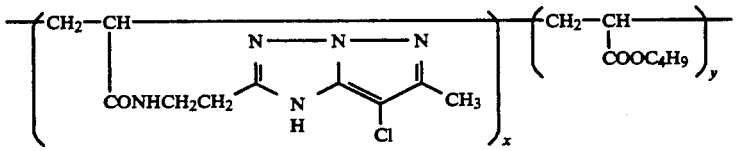

x:y = 50:50

89

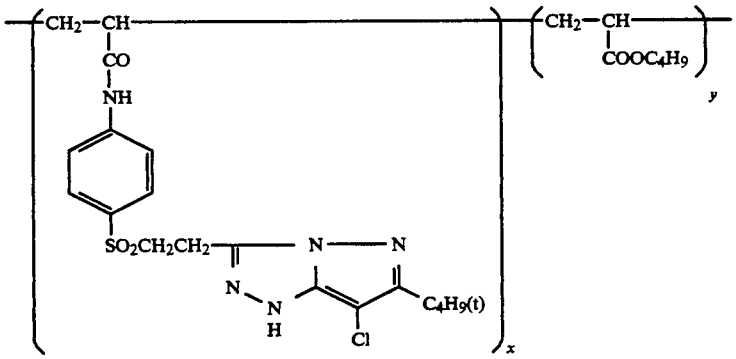

x:y = 50:50

90

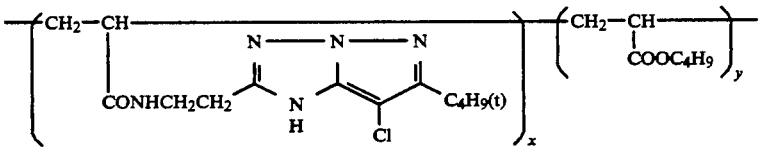

x:y = 50:50

In addition to the typical examples given above, the compound of the present invention is also exemplified by Compound Nos. 1-4, 6, 8-17, 19-24, 26-43, 45-59, 61-104, 106-121, 123-162 and 164-223 described in Japanese Patent O.P.I. Publication No. 166339/1987, pp. 18-32.

The couplers described above can be synthesized, for example, in accordance with the Journal of the Chemical Society, Perkin, I (1977), 2047-2052, U.S. Pat. No. 3,725,067, Japanese Patent O.P.I. Publication Nos. 99437/1984, 42045/1983, 162548/1984, 171956/1984, 33552/1985, 43659/1985, 172982/1985, 190779/1985, 209457/1987 and 307453/1988.

The coupler of the present invention can be used usually at 1 to $10^{-3}$ to 1 mol, preferably $1\times10^{-2}$ to $8\times10^{-1}$ mol per mol of silver halide.

The coupler of the invention may be used in combination with other magenta couplers.

The present invention is applicable to color photographic light-sensitive materials such as color negative films for ordinary or movie use and color reversal films for slide or television use.

EXAMPLES

In all the examples given below, the amount of addition to the silver halide color photographic light-sensitive material is expressed in gram per $m^2$. The amounts of silver halide and colloidal silver are as converted to the amount of silver. The amount of sensitizing dye is expressed in mol per mol of silver.

EXAMPLE 1

The following layers with the compositions shown below were sequentially formed on a triacetyl cellulose film support in the order from the support side to yield a multiple-layered color photographic light-sensitive material sample No. 1.

| Sample 1 (comparative) | |
|---|---|
| Layer 1: Anti-halation layer HC | |
| Black colloidal silver | 0.15 |
| UV absorbent UV-1 | 0.18 |
| Colored cyan coupler CC-1 | 0.02 |
| High boiling solvent Oil-1 | 0.18 |
| High boiling solvent Oil-2 | 0.20 |
| Gelatin | 1.6 |
| Layer 2: Interlayer IL-1 | |
| Gelatin | 1.3 |
| Layer 3: Low speed red-sensitive emulsion layer RL | |
| Silver chlorobromide emulsion Em-1 | 0.4 |
| Silver chlorobromide emulsion Em-2 | 0.3 |
| Sensitizing dye S-1 | $3.2 \times 10^{-4}$ mol/mol silver |
| Sensitizing dye S-2 | $3.2 \times 10^{-4}$ mol/mol silver |
| Sensitizing dye S-3 | $0.2 \times 10^{-4}$ mol/mol silver |
| Cyan coupler C-1 | 0.50 |
| Cyan coupler C-2 | 0.15 |
| Colored cyan coupler CC-1 | 0.07 |
| DIR compound D-1 | 0.006 |
| DIR compound D-2 | 0.01 |
| High boiling solvent Oil-1 | 0.60 |
| Gelatin | 1.0 |
| Layer 4: High speed red-sensitive emulsion layer RH | |
| Silver chlorobromide emulsion Em-3 | 0.95 |
| Sensitizing dye S-1 | $1.7 \times 10^{-4}$ mol/mol silver |
| Sensitizing dye S-2 | $1.6 \times 10^{-4}$ mol/mol silver |
| Sensitizing dye S-3 | $0.1 \times 10^{-4}$ mol/mol silver |
| Cyan coupler C-2 | 0.23 |
| Colored cyan coupler CC-1 | 0.03 |
| DIR compound D-2 | 0.02 |
| High boiling solvent Oil-1 | 0.30 |
| Gelatin | 1.0 |
| Layer 5: Interlayer IL-2 | |
| Gelatin | 0.8 |
| Layer 6: Low speed green-sensitive emulsion layer GL | |
| Silver chlorobromide emulsion Em-1 | 0.6 |
| Silver chlorobromide emulsion Em-2 | 0.3 |
| Sensitizing dye S-4 | $6.7 \times 10^{-4}$ mol/mol silver |
| Sensitizing dye S-5 | $0.8 \times 10^{-4}$ mol/mol silver |
| Magenta coupler M-1 | 0.19 |
| Magenta coupler M-2 | 0.43 |
| Colored magenta coupler CM-1 | 0.11 |
| DIR compound D-3 | 0.02 |
| High boiling solvent Oil-2 | 0.70 |
| Gelatin | 1.0 |
| Layer 7: High speed green-sensitive emulsion layer GH | |
| Silver chlorobromide emulsion Em-3 | 0.9 |
| Sensitizing dye S-6 | $1.1 \times 10^{-4}$ mol/mol silver |
| Sensitizing dye S-7 | $2.0 \times 10^{-4}$ mol/mol silver |
| Sensitizing dye S-8 | $0.3 \times 10^{-4}$ mol/mol silver |
| Magenta coupler M-1 | 0.03 |
| Magenta coupler M-2 | 0.13 |
| Colored magenta coupler CM-1 | 0.04 |
| DIR compound D-3 | 0.004 |
| High boiling solvent Oil-2 | 0.45 |
| Gelatin | 1.0 |
| Layer 8: Yellow filter layer YC | |
| Yellow colloidal silver | 0.1 |
| Additive HS-1 | 0.07 |
| Additive HS-2 | 0.04 |
| Additive SC-1 | 0.12 |
| High boiling solvent Oil-2 | 0.15 |
| Gelatin | 1.0 |
| Layer 9 Low speed blue-sensitive emulsion layer BL | |
| Silver chlorobromide emulsion Em-1 | 0.25 |
| Silver chlorobromide emulsion Em-2 | 0.25 |
| Sensitizing dye S-9 | $5.8 \times 10^{-4}$ mol/mol silver |
| Yellow coupler Y-1 | 0.60 |
| Yellow coupler Y-2 | 0.32 |
| DIR compound D-1 | 0.003 |
| DIR compound D-2 | 0.006 |
| High boiling solvent Oil-2 | 0.20 |
| Gelatin | 1.3 |
| Layer 10: High speed blue-sensitive emulsion layer BH | |
| Silver chlorobromide emulsion Em-4 | 0.5 |
| Sensitizing dye S-10 | $3.0 \times 10^{-4}$ mol/mol silver |
| Sensitizing dye S-11 | $1.2 \times 10^{-4}$ mol/mol silver |
| Yellow coupler Y-1 | 0.20 |

-continued

| Sample 1 (comparative) | |
|---|---|
| Yellow coupler Y-2 | 0.10 |
| High boiling solvent Oil-2 | 0.05 |
| Gelatin | 1.0 |
| Layer 11: First protective layer PRO-1 | |
| Silver chlorobromide emulsion Em-5 | 0.3 |
| UV absorbent UV-1 | 0.09 |
| UV absorbent UV-2 | 0.1 |
| Additive HS-1 | 0.2 |
| Additive HS-2 | 0.1 |
| High boiling solvent Oil-1 | 0.07 |
| High boiling solvent Oil-3 | 0.07 |
| Gelatin | 0.8 |
| Layer 12: Second protective layer PRO-2 | |
| Alkali-soluble matting agent (average grain size 2 μm) | 0.13 |
| Polymethyl methacrylate (average grain size 3 μm) | 0.02 |
| Gelatin | 0.5 |

In addition to these compositions, a coating aid SU-2, a dispersing agent SU-1, hardeners H-1 and H-2 and dyes AI-1 and AI-2 were added to appropriate layers. The following emulsions were used to prepare the sample described above, all of which are monodispersed emulsions.

Em-1: Cubic grains having an average AgCl content which was varied for each samples as listed in Table 1, a side length of 0.46 μm and a distribution width of 10%.

Em-2: Cubic grains having an average AgCl content which was varied for each samples as listed in Table 1, a side length of 0.30 μm and a distribution width of 10%.

Em-3: Cubic grains having an average AgCl content which was varied for each samples as listed in Table 1, a side length of 0.70 μm and a distribution width of 8%.

Em-4: Cubic grains having an average AgCl content which was varied for each samples as listed in Table 1, a side length of 0.85 μm and a distribution width of 8%.

Em-5: Cubic grains having an average AgCl content which was varied for each samples as listed in Table 1 and a side length of 0.07 μm.

The total amount of silver coated (totalized for all emulsion layers) in the color negative film sample thus prepared was 5.00 g/m$^2$.

Experimental samples were prepared in the same manner as above except that the total amount of silver coated was changed as shown in the following Table 1 so that the ratio of the amount of silver coated in each emulsion layer became the same as the ratio of the amount of silver coated on each layer of the above-mentioned color negative film sample with a total amount of silver coated of 5.00 g/m$^2$.

C-1

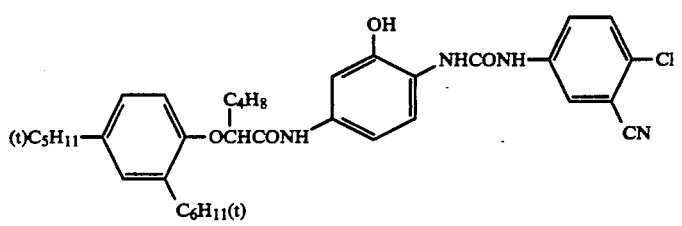

C-2

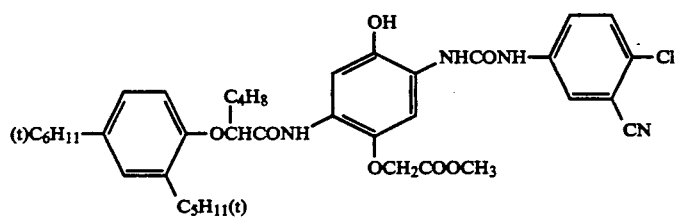

M-1

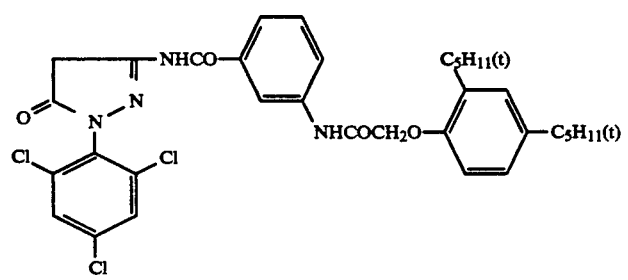

-continued
M-2
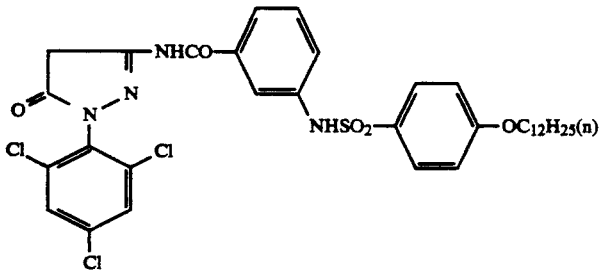
Y-1
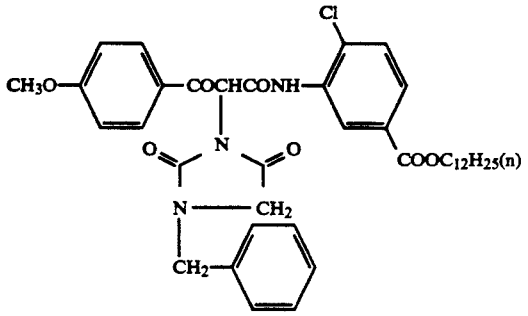
Y-2
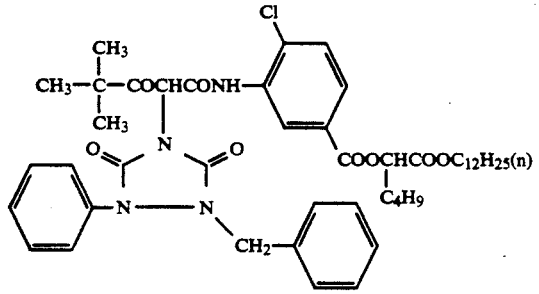
CC-1
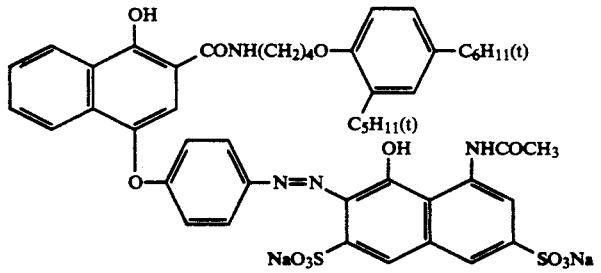
CM-1
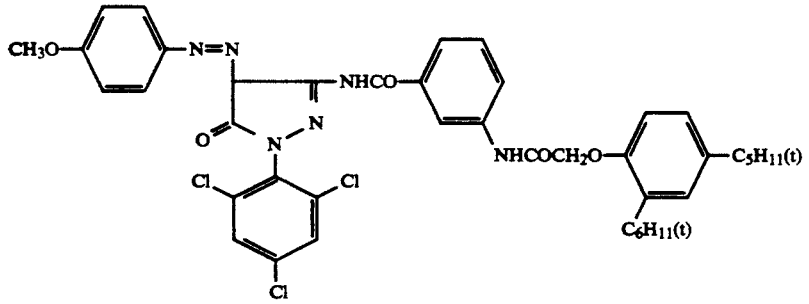

-continued
D-1
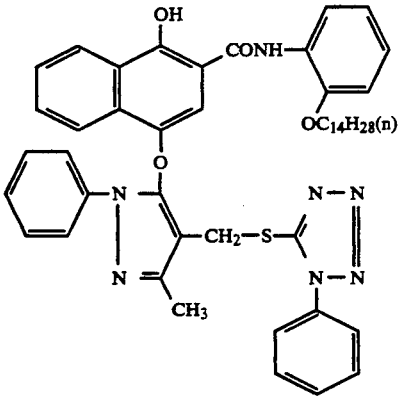
D-2
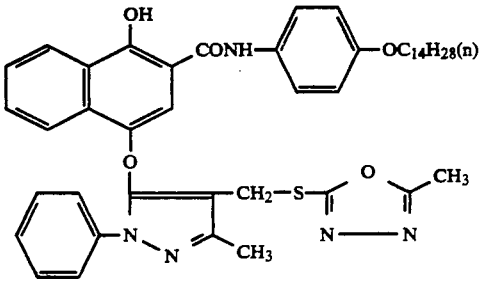
D-3
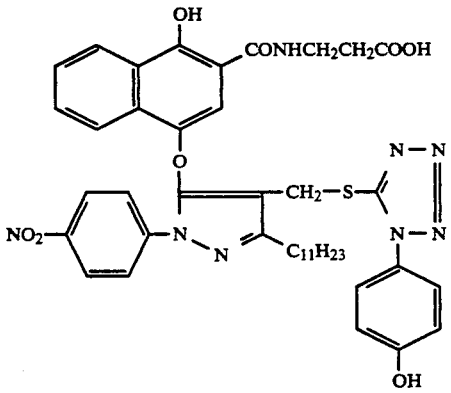
UV-1
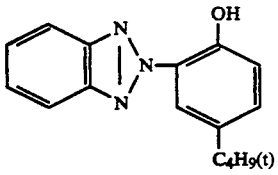
UV-2
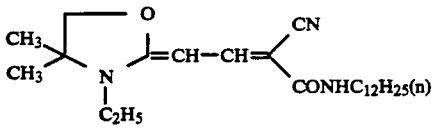
S-1
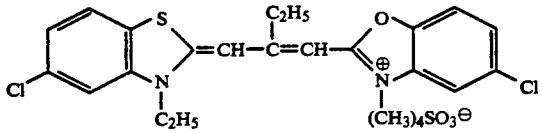

-continued
S-2
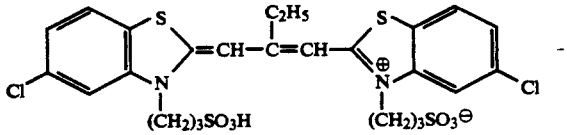
S-3
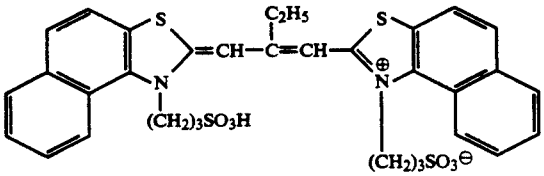
S-4
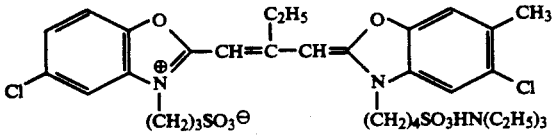
S-5
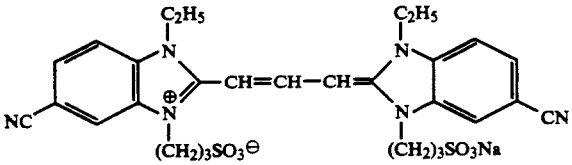
S-6
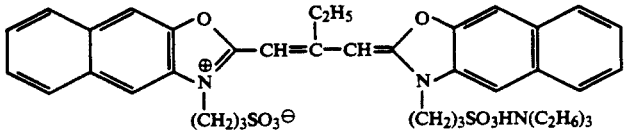
S-7
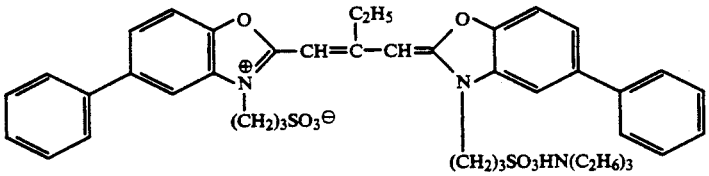
S-8
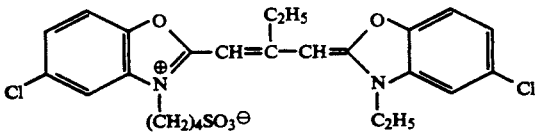
S-9
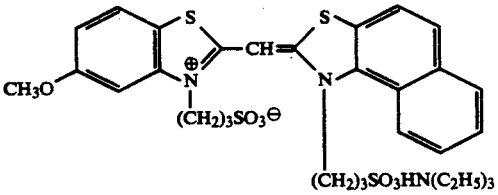
S-10
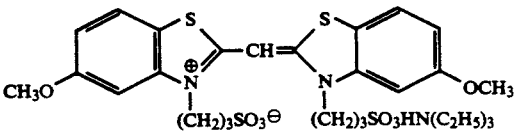

-continued
S-11
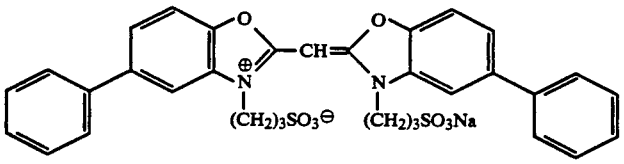
HS-1
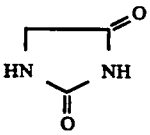
HS-2
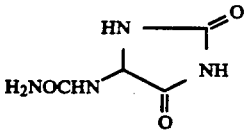
H-1
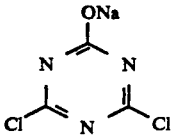
H-2
$((CH_2{=}CHSO_2CH_2)_3CCH_2SO_2(CH_2)_2)_2N(CH_2)_2SO_3K$
SU-1
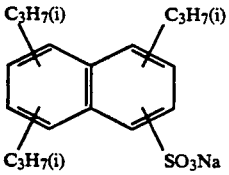
(Alkanol XC)
SU-2
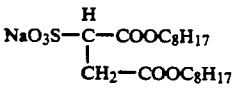
SC-1
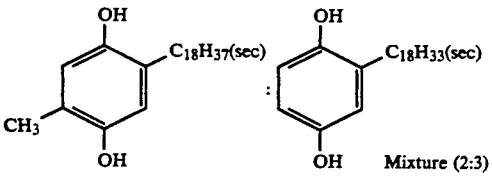
Mixture (2:3)
Oil-1
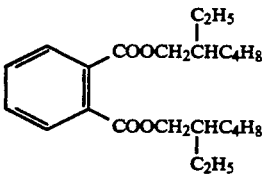
Oil-2
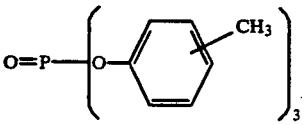
Oil-3
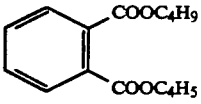

-continued

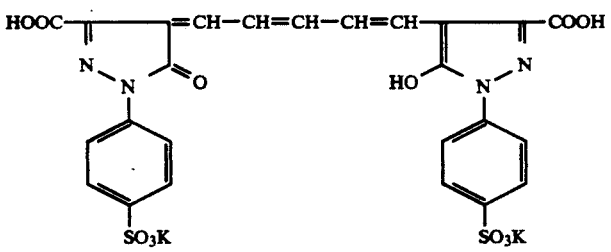

AI-1

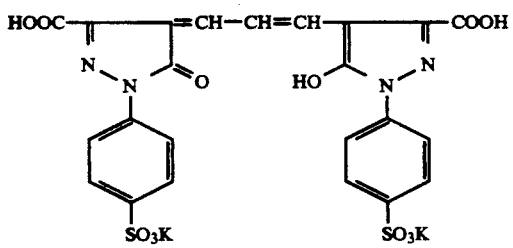

AI-2

The color film samples thus prepared were subjected to exposure and then processed using the following procedures and processing solutions:

| Procedure | Processing time | Processing temperature | Amount of replenisher |
|---|---|---|---|
| Color development | 40 seconds | 38° C. | 500 ml |
| Bleaching | 30 seconds | 38° C. | 155 ml |
| Fixation | 60 seconds | 38° C. | 500 ml |
| Stabilization | 60 seconds | 38° C. | 700 ml |
| Drying | 60 seconds | 40 to 70° C. | — |

Note: Figures for the amount of replenisher are per $m^2$ of light-sensitive material.

| Color developer tank solution | |
|---|---|
| Triethanolamine | 10 g |
| Diethylene glycol | 1 g |
| N,N-diethylhydroxylamine | 3.6 g |
| Hydrazinodiacetic acid | 5.0 g |
| Potassium bromide | 20 mg |
| Potassium chloride | 2.5 g |
| Ethylenetriaminetetraacetic acid | 5 g |
| Potassium sulfite | $5.0 \times 10^{-3}$ mol |
| Color developing agent listed in Table 1 | 5.5 g |
| Potassium carbonate | 25 g |
| Potassium hydrogen carbonate | 5 g |

Water was added to make a total quantity of 1l, and potassium hydroxide or sulfuric acid was added to obtain a pH of 10.10.

| Color developer replenisher | |
|---|---|
| Triethanolamine | 10 g |
| Diethylene glycol | 1 g |
| N,N-diethylhydroxylamine | 4.2 g |
| Hydrazinodiacetic acid | 6.0 g |
| Ethylenediaminetetraacetic acid | 5 g |
| Potassium sulfite | $5.0 \times 10^{-3}$ mol |
| Color developing agent listed in Table 1 | 8.8 g |
| Potassium carbonate | 25 g |
| Potassium hydrogen carbonate | 5 g |

Water was added to make a total quantity of 1l, and potassium hydroxide or sulfuric acid was added to obtain a pH of 10.40.

The bleacher used had the following composition.

| | |
|---|---|
| Ferric ammonium 1,3-propylenediamine-tetraacetate | 100 g |
| Disodium ethylenediaminetetraacetate | 10 g |
| Potassium bromide | 120 g |
| Glacial acetic acid | 50 ml |

Water was added to make a total quantity of 1l, and aqueous ammonia or glacial acetic acid was added to obtain a pH of 3.50.

The bleacher replenisher used had the following composition.

| | |
|---|---|
| Ferric ammonium 1,3-propylenediamine-tetraacetate | 130 g |
| Disodium ethylenediaminetetraacetate | 10 g |
| Potassium bromide | 150 g |
| Glacial acetic acid | 70 ml |

Water was added to make a total quantity of 1l, and aqueous ammonia or glacial acetic acid was added to obtain a pH of 4.40.

The fixer tank solution and fixer replenisher used had the following compositions.

| | |
|---|---|
| Ammonium thiosulfate | 250 g |
| Anhydrous sodium bisulfite | 12 g |
| Sodium metabisulfite | 2.5 g |
| Disodium ethylenediaminetetraacetate | 0.5 g |

Water was added to make a total quantity of 1l and acetic acid and aqueous ammonia were added to obtain a pH of 7.0.

The stabilizer tank solution and stabilizer replenisher used had the following compositions.

| | |
|---|---|
| Formaldehyde (37% solution) | 0.5 ml |
| 5-chloro-2-methyl-4-isothiazolin-3-one | 0.05 g |
| Emulgen 810 | 1 ml |
| Hexahydro-1,3,5-tris-(2-hydroxyethyl)-5-triazine | 0.3 g |
| Sodium salt of formaldehyde adduct of bisulfite | 2 g |
| Hexamethylenetetramine | 1.0 g |

Water was added to make a total quantity of 11, and aqueous ammonia and 50% sulfuric acid were added to obtain a pH of 7.0.

Continuous processing was carried out with a color developing agent varied as shown in Table 1 so that the total amount of the color developer replenisher added became 3 times the capacity of the color developer tank.

The color developer tank was examined for silver sludge and the degree of silver sludge was evaluated using the criteria of A for no occurrence, B for slight occurrence and C for moderate to severe occurrence. Those marked with two symbols are evaluated as intermediate therebetween (the same applies to the examples below.)

After completion of the running test, the green light transmission density, i.e. red density, in the unexposed portion of the processed film sample was determined. Also determined was the fluctuation width of red density in the portion having maximum density in the film samples in the course of continuous processing. The results are shown in Table 1.

TABLE 1

| Experiment number | Light-sensitive material: Amount of silver coated ($g/m^2$) | Light-sensitive material: Silver chloride content (mol %) | Color developing agent | Ag sludge | Red density in the unexposed portion | Fluctuation width of maximum red density | Remark |
|---|---|---|---|---|---|---|---|
| 1-1 | 1 | 80 | 1-1 | A | 0.51 | 0.30 | Comparative |
| 1-2 | 1.5 | 80 | 1-1 | A | 0.51 | 0.10 | Comparative |
| 1-3 | 2.0 | 80 | 1-1 | A | 0.51 | 0.05 | Inventive |
| 1-4 | 3.0 | 80 | 1-1 | A | 0.50 | 0.04 | Inventive |
| 1-5 | 5.0 | 80 | 1-1 | A | 0.50 | 0.04 | Inventive |
| 1-6 | 7.0 | 80 | 1-1 | A | 0.50 | 0.04 | Inventive |
| 1-7 | 9.0 | 80 | 1-1 | B-A | 0.50 | 0.04 | Inventive |
| 1-8 | 12.0 | 80 | 1-1 | B-A | 0.52 | 0.04 | Inventive |
| 1-9 | 13.0 | 80 | 1-1 | B-A | 0.53 | 0.04 | Inventive |
| 1-10 | 15.0 | 80 | 1-1 | B | 0.54 | 0.04 | Inventive |
| 1-11 | 5.0 | 30 | 1-1 | A | 0.55 | 0.09 | Comparative |
| 1-12 | 5.0 | 40 | 1-1 | A | 0.51 | 0.06 | Comparative |
| 1-13 | 5.0 | 50 | 1-1 | A | 0.50 | 0.04 | Inventive |
| 1-14 | 5.0 | 65 | 1-1 | A | 0.50 | 0.04 | Inventive |
| 1-15 | 5.0 | 80 | 1-1 | A | 0.50 | 0.04 | Inventive |
| 1-16 | 5.0 | 90 | 1-1 | A | 0.50 | 0.04 | Inventive |
| 1-17 | 5.0 | 95 | 1-1 | A | 0.50 | 0.04 | Inventive |
| 1-18 | 5.0 | 99 | 1-1 | A | 0.50 | 0.04 | Inventive |
| 1-19 | 5.0 | 99.5 | 101 | A | 0.50 | 0.04 | Inventive |
| 1-20 | 5.0 | 10 | 1-A | B | 0.80 | 0.30 | Comparative |
| 1-21 | 5.0 | 50 | 1-A | C-B | 0.70 | 0.20 | Comparative |
| 1-22 | 5.0 | 80 | 1-A | C | 0.60 | 0.10 | Comparative |
| 1-23 | 5.0 | 80 | 1-B | B-A | 0.60 | 0.30 | Comparative |
| 1-24 | 5.0 | 80 | 1-C | A | 0.65 | 0.30 | Comparative |
| 1-25 | 5.0 | 80 | 1-D | B-A | 0.70 | 0.40 | Comparative |
| 1-26 | 5.0 | 80 | 1-1 | B-A | 0.50 | 0.04 | Inventive |
| 1-27 | 5.0 | 80 | 1-3 | B-A | 0.51 | 0.05 | Inventive |

TABLE 1-continued

| Experiment number | Light-sensitive material: Amount of silver coated ($g/m^2$) | Light-sensitive material: Silver chloride content (mol %) | Color developing agent | Ag sludge | Red density in the unexposed portion | Fluctuation width of maximum red density | Remark |
|---|---|---|---|---|---|---|---|
| 1-28 | 5.0 | 80 | 1-6 | A | 0.50 | 0.05 | Inventive |

In Table 1,
1-A represents

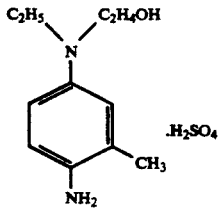

1-B represents

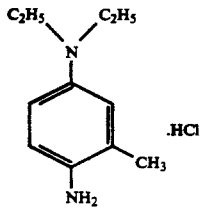

1-C represents

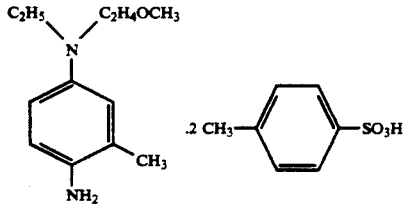

1-D represents

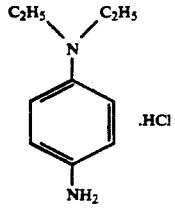

From Table 1, it is evident that when a light-sensitive material wherein the amount of silver coated is not less than 2 $g/m^2$ and the silver chloride content is not less than 50 mol% is processed with the color developing agent represented by the formula I, the green color density or fogging density in the unexposed portion is low, the fluctuation width of maximum density due to running processing is narrow and a good suppressive effect on the occurrence of sludge in the color developer is obtained.

EXAMPLE 2

Experiments and evaluation were made in the same manner as in Experiments 1-1 to 1-5 of Example 1 except that the color developing time for Experiment Nos. 1 through 5 was changed as shown in Table 2. The transmission red density in the most dense portion was also determined. The results are shown in Table 2.

TABLE 2

| Experiment number | Color developing time | Ag sludge | Red density in the unexposed portion | Fluctuation width of maximum red density | Transmission red density in the most dense portion |
|---|---|---|---|---|---|
| 2-1 | 200 sec. | B | 0.55 | 0.04 | 1.98 |
| 2-2 | 150 sec. | B - A | 0.52 | 0.04 | 1.96 |
| 2-3 | 60 sec. | B - A | 0.51 | 0.04 | 1.96 |
| 2-4 | 30 sec. | A | 0.50 | 0.04 | 1.96 |
| 2-5 | 20 sec. | A | 0.50 | 0.04 | 1.85 |
| 2-6 | 10 sec. | A | 0.49 | 0.05 | 1.80 |

As is evident from Table 2, when the color developing time is short, a well-balanced improvement in Ag sludge and fogging density in the unexposed portion is obtained.

EXAMPLE 3

Continuous processing and evaluation were made in the same manner as in Experiments 1-1 to 1-5 of Example 1 except that the amount of color developer replenisher for Experiment Nos. 1 through 5 was changed as shown in Table 3. The results are shown in Table 3.

TABLE 3

| Experiment number | Amount of replenisher (ml/m²) | Ag sludge | Red density in the unexposed portion | Fluctuation width of maximum red density |
|---|---|---|---|---|
| 3-1 | 1100 | B - A | 0.56 | 0.05 |
| 3-2 | 900 | B - A | 0.52 | 0.05 |
| 3-3 | 700 | B - A | 0.50 | 0.04 |
| 3-4 | 500 | B - A | 0.50 | 0.04 |
| 3-5 | 300 | B - A | 0.49 | 0.04 |

As is evident from Table 3, when the amount of replenisher is below 900 ml/m², better results are obtained, i.e., the fogging density in the unexposed portion is low while suppressing Ag sludge and scattering of the most dense portion.

EXAMPLE 4

Continuous processing and evaluation were made in the same manner as in Experiments 1-1 to 1-5 of Example 1 except that the chelating agent added to the color developer for Experiment Nos. 1 through 5 was changed as shown in Table 4. Also observed was the color developer tank for tar formation. The evaluation criteria used are A for no occurrence, B for slight occurrence, and C for moderate to severe occurrence. Those marked with two symbols mean an intermediate evaluation therebetween.

TABLE 4

| Experiment number | Chelating agent | Ag sludge | Red density in the unexposed portion | Status of tar formation |
|---|---|---|---|---|
| 4-1 | Ethylenediaminetetraacetic acid | B - A | 0.50 | B |
| 4-2 | Triethylenetetraminehexamethylenephosphonic acid | A | 0.50 | B |
| 4-3 | Diethylenetriaminepentaacetic acid | A | 0.49 | A |
| 4-4 | Hydroxyiminodiacetic acid | B - A | 0.51 | B |

As is evident from Table 4, when the chelating agent represented by the formula E (Experiment Nos. 4-2 and 4-3) is used in combination with the present invention, not only Ag sludge is suppressed but also a suppressive effect on tar formation is obtained.

EXAMPLE 5

Experiments and evaluation were made in the same manner as in Experiments 1-1 to 1-5 of Example 1 except that the sulfite concentration in the color developer for Experiment Nos. 1 through 5 was changed as shown in Table 5. The results are shown in Table 5.

TABLE 5

| Experiment number | Sulfite concentration (mol/l) | Red density in the unexposed portion | Fluctuation width of maximum red density |
|---|---|---|---|
| 5-1 | $3 \times 10^{-2}$ | 0.55 | 0.18 |
| 5-2 | $1.6 \times 10^{-2}$ | 0.51 | 0.06 |
| 5-3 | $1 \times 10^{-2}$ | 0.50 | 0.05 |
| 5-4 | $8 \times 10^{-3}$ | 0.50 | 0.04 |
| 5-5 | $4 \times 10^{-3}$ | 0.50 | 0.04 |
| 5-6 | $1 \times 10^{-3}$ | 0.50 | 0.04 |

As is evident from Table 5, when the sulfite concentration is decreased, the effect of the present invention is enhanced.

EXAMPLE 6

Experiments and evaluation were made in the same manner as in Experiments 1-1 to 1-5 of Example 1 except that the potassium chloride concentration in the color developer for Experiment Nos. 1 through 5 was changed. The results are shown in Table 6.

TABLE 6

| Experiment number | Chloride concentration (mol/l) | Red density in the unexposed portion | Fluctuation width of maximum red density |
|---|---|---|---|
| 6-1 | $1 \times 10^{-2}$ | 0.52 | 0.08 |
| 6-2 | $3 \times 10^{-2}$ | 0.50 | 0.04 |
| 6-3 | $5 \times 10^{-2}$ | 0.50 | 0.04 |
| 6-4 | $1 \times 10^{-1}$ | 0.50 | 0.04 |
| 6-5 | $2 \times 10^{-1}$ | 0.49 | 0.07 |
| 6-6 | $8 \times 10^{-1}$ | 0.49 | 0.10 |

As is evident from Table 6, when the chloride concentration is changed to $3\times10^{-2}$ to $2\times10^{-1}$ mol/l, a better effect is obtained.

EXAMPLE 7

Experiments were made in the same manner as in Example 1 except that the magenta coupler M-2 in the color negative films prepared in Example 1 was changed to the magenta coupler represented by the formula M-1, specifically Exemplified Magenta Couplers 1, 2, 4, 10, 20, 21, 31, 40, 60, 63, 64, 74, 76 and 81, respectively.

As a result, the magenta fogging density in the unexposed portion improved by 10 to 20%, and slight but general improvement was obtained in the suppression of silver sludge, compared to the results of Example 1.

EXAMPLE 8

Experiments were made in the same manner as in Example 1 except that the diethylhydroxylamine in the color developer for Experiment Nos. 1 through 14 was replaced with an equal mol of a compound listed in the following Table 7. The transmission cyan density in the maximum density portion in the processed film samples after running processing using a densitometer with red light. The results are shown in Table 7.

TABLE 7

| Experiment number | Additive | Ag sludge | Width of distribution of most dense portion | Transmission cyan density in the maximum density portion |
|---|---|---|---|---|
| 7-1 | Not added | B | 0.08 | 2.01 |
| 7-2 | Hydroxylamine sulfate | B | 0.05 | 1.23 |
| 7-3 | (A-1) | A | 0.04 | 2.28 |
| 7-4 | (A-2) | A | 0.05 | 2.25 |
| 7-5 | (A-10) | A | 0.04 | 2.27 |
| 7-6 | (A-13) | A | 0.02 | 2.30 |
| 7-7 | (A-15) | A | 0.03 | 2.31 |
| 7-8 | (A-18) | A | 0.02 | 2.30 |
| 7-9 | (A-21) | A | 0.02 | 2.31 |
| 7-10 | (A-40) | A | 0.02 | 2.32 |
| 7-11 | (A-41) | A | 0.02 | 2.30 |
| 7-12 | (B-5) | A | 0.04 | 2.25 |
| 7-13 | (B-19) | A | 0.03 | 2.31 |
| 7-14 | (B-20) | A | 0.03 | 2.32 |

As is evident from Table 7, when the compound represented by the formula A or B is used in combination with the processing method of the present invention, the effect of the invention is enhanced.

What is claimed is:

1. A method for forming a color photographic image comprising steps of imagewise exposing to light a silver halide color photographic light-sensitive material which has a silver halide emulsion layer containing silver halide grains having a silver chloride content of not less than 50 mol%, and the amount of silver coated on said light-sensitive material is not less than 2 g/m$^2$ in total, and developing said exposed light-sensitive material with a color developer containing a color developing agent represented by the following Formula I;

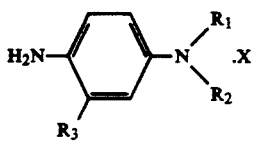

(I)

wherein $R_1$, $R_2$ and $R_3$ are independently a methyl group, an ethyl group, a propyl group, a hydroxyethyl group, sulfon-alkyl group or a $\beta$-methanesulfonamidoethyl group, provided that at least one of groups represented by $R_1$, $R_2$ and $R_3$ is a $\beta$-methanesulfonamidoethyl group; X is surfuric acid, hydrochloric acid, p-toluenesulfonic acid or phosphoric acid.

2. A method of claim 1, wherein said developing step is carried out for a time of not more than 150 seconds.

3. A method of claim 2, wherein said developing step is carried out for a time of from 10 seconds to 120 seconds.

4. A method of claim 1, wherein said developer is replenished with a developer replenisher in a ratio of not more than 900 ml per square meter of the light-sensitive material processed in said developer.

5. A method of claim 4, wherein said developer is replenished with a developer replenisher in a ratio of from 20 ml to 700 ml per square meter of the light-sensitive material processed in said developer.

6. A method of claim 1, wherein said color developer contains a compound represented by the following Formula A or B;

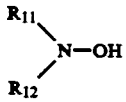

(A)

wherein $R_{11}$ and $R_{12}$ are independently a hydrogen atom, an alkyl group, an aryl group or a R'—CO— group, provided that $R_{11}$ and $R_{12}$ are not hydrogen atoms at the same time, R' is an alkoxy group, an alkyl group or a aryl group, $R_{11}$ and $R_{12}$ may be bonded to form a ring,

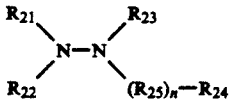

(B)

wherein $R_{21}$, $R_{22}$ and $R_{23}$ are independently a hydrogen atom, an alkyl group, an aryl group or a heterocyclic group; $R_{24}$ is a hydroxyl group, a hydroxyamino group, an alkyl group, an aryl group, a heterocyclic group, an alkoxy group, an aryloxy group, a carbamoyl group, or an amino group; $R_{25}$ is a —CO— group, a —$SO_2$— group or a

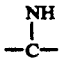

group; n is 0 or 1; and $R_{23}$ and $R_{24}$ may be bonded to form a ring.

7. A method of claim 6, wherein said compound represented by Formula A or Formula B is contained in said color developer in an amount of from 0.4 g per liter to 100 g per liter.

8. A method of claim 1, wherein said color developer contains a chloride in an amount of from $3.5\times10^{-2}$ mol per liter to $20\times10^{-2}$ mol per liter.

9. A method of claim 1, wherein said color developer contains a sulfite in an amount of not more than $1.6\times10^{-2}$mol per liter.

10. A method of claim 1, wherein said color developing agent is contained in said color developer in an amount of from $1\times10^{-2}$ mol per liter to $2\times10^{-1}$ mol per liter.

11. A method of claim 10, wherein said amount of said color developing agent is $1.5\times10^{-2}$ per liter to $2\times10^{-1}$ per liter.

12. A method of claim 1, wherein said silver halide grains have a silver chloride content of not less than 80 mol%.

13. A method of claim 1, wherein said total amount of silver is within the range of from 3 g/m$^2$ to 12 g/m$^2$.

14. A method of claim 1, wherein said light-sensitive material contains a magenta coupler represented by the following Formula M-I;

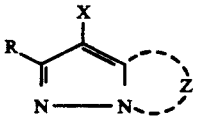

(M-I)

wherein Z is a group of atoms necessary for forming a heterocyclic ring; X is a hydrogen atom or a substituent capable of splitting off upon reaction with the oxidation product of a color developing agent; and R is a hydrogen atom or a substituent.

15. A method for forming a color photographic image comprising steps of imagewise exposing a silver halide color photographic light-sensitive material which has a silver halide emulsion layer containing silver halide grains having a silver chloride content of not less than 50 mol% and a magenta coupler represented by the following Formula M-I, and the amount of silver coated on said light-sensitive material is not less than 2 g/m$^2$ in total;

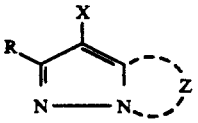

(M-I)

wherein Z is a group of atoms necessary for forming a heterocyclic ring; X is a hydrogen atom or a substituent capable of splitting of upon reaction with the oxidation product of a color developing agent; and R is a hydrogen atom or substituent, and developing said exposed light-sensitive material with a color developer containing a color developing agent represented by the following Formula I in an amount of from $1\times10^{-2}$ mol to $2\times10^{-1}$ mol per liter, a compound represented by the following formula A or B in an amount of from 0.4 g to 100 g per liter, and a chloride in an amount of from $3.5\times10^{-1}$ mol to $20\times10^{-2}$ mol per liter, and said developer is replenished with a developer replenisher in a ratio of from 20 ml to 700 ml per square meter of said light-sensitive material processed in said developer;

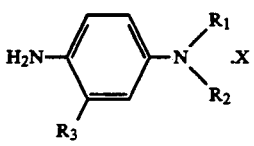

(I)

wherein $R_1$, $R_2$ and $R_3$ are independently a methyl group, an ethyl group, a propyl group, a hydroxyethyl group, a sulfonalkyl group or a β-methanesulfonamidoethyl group, provided that at least one of the groups represented by $R_1$, $R_2$ and $R_3$ is a β-methanesulfonamidoethyl group; X is sulfuric acid, hydrochloric acid, p-toluene-sulfonic acid or phosphoric acid;

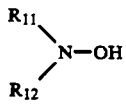

(A)

wherein $R_{11}$ and $R_{12}$ are independently a hydrogen atom, an alkyl group, an aryl group or a R'—CO— group, provided that $R_{11}$ and $R_{12}$ are not hydrogen atoms at the same time, R' is an alkoxy group, an alkyl group or an aryl group, $R_{11}$ and $R_{12}$ may be bonded to form a ring;

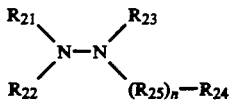

(B)

wherein $R_{21}$, $R_{22}$ and $R_{23}$ are independently a hydrogen atom, an alkyl group, an aryl group or a heterocyclic group; $R_{24}$ is a hydroxyl group, a hydroxyamino group, an alkyl group, an aryl group, a heterocyclic group, an alkoxy group, an aryloxy group, a carbamoyl group, or an amino group; $R_{25}$ is a —CO— group, a —$SO_2$— group or a

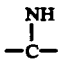

group; n is 0 or 1; and $R_{23}$ and $R_{24}$ may be bonded to form a ring.

16. A method for forming a color photographic image comprising steps of imagewise exposing to light a silver halide color photographic light-sensitive material which has a silver halide emulsion layer containing silver halide grains having a silver chloride content of not less than 50 mol%, and the amount of silver coated on said light sensitive material is not less than 2 g/m² in total, and developing said exposed light-sensitive material with a color developer containing a color developing agnet represented by the following Formula I and one of the following compounds A-13, A-14, A-15, A-18, A-21, A-40, B-19, B-20;

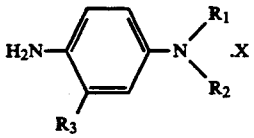

(I)

wherein $R_1$, $R_2$ and $R_3$ are independently a methyl group, an ethyl group, a propyl group, a hydroxyethyl group, a sulfonalkyl group or a β-methanesulfonamidoethyl group, provided that at least one of the groups represented by $R_1$, $R_2$ and $R_3$ is a β-methanesulfonamidoethyl group; X is sulfuric acid, hydrochloric acid, p-toluenesulfonic acid or phosphoric acid;

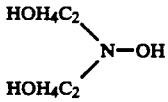

(A-13)

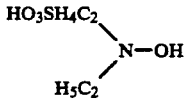

(A-14)

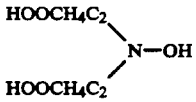

(A-15)

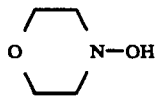

(A-18)

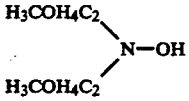

(A-21)

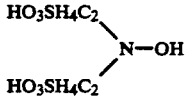

(A-40)

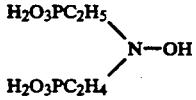

(A-41)

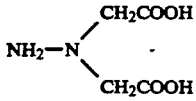

(B-19)

-continued

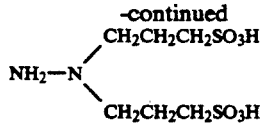

(B-20)

17. A method of claim 16, wherein said developing step is carried out for a time of not more than 150 seconds.

18. A method of claim 16, wherein said developer is replenished with a developer replenisher in a ratio of not more than 900 ml per square meter of the light-sensitive material processed in said developer.

19. A method of claim 16, wherein said color developing agent is contained in said color developer in an amount of from $1\times10^{-2}$ mol per liter to $2\times10^{-1}$ mol per liter.

20. A method of claim 16, wherein said silver halide grains have a silver chloride content of not less than 80 mol%.

* * * * *